United States Patent [19]

Sakanoue et al.

[11] Patent Number: 4,789,626

[45] Date of Patent: Dec. 6, 1988

[54] METHOD FOR PROCESSING SILVER HALIDE COLOR PHOTOGRAPHIC MATERIALS CONTAINING SENSITIZING DYES AND TWO-EQUIVALENT MAGENTA POLYMER COUPLERS

[75] Inventors: Kei Sakanoue; Shinzo Kishimoto; Tadashi Ikeda, all of Kanagawa, Japan

[73] Assignee: Fuji Photo Film Co., Ltd., Kanagawa, Japan

[21] Appl. No.: 940,839

[22] Filed: Dec. 12, 1986

[30] Foreign Application Priority Data

Dec. 13, 1985 [JP] Japan ..... 60-280375

[51] Int. Cl.[4] ..... G03C 7/00; G03C 7/40; G03C 1/08; G03C 7/32

[52] U.S. Cl. ..... 430/393; 430/372; 430/375; 430/381; 430/386; 430/387; 430/428; 430/463; 430/476; 430/548; 430/558

[58] Field of Search ..... 430/372, 381, 386, 387, 430/375, 428, 463, 476, 558, 548, 393

[56] References Cited

U.S. PATENT DOCUMENTS

| | | | |
|---|---|---|---|
| 4,367,282 | 1/1983 | Yasihara et al. | 430/548 |
| 4,474,870 | 10/1984 | Yasihara et al. | 430/381 |
| 4,522,916 | 6/1985 | Hirano | 430/381 |
| 4,551,424 | 11/1985 | Ikeda et al. | 430/588 |
| 4,555,481 | 11/1985 | Ukai et al. | 430/588 |
| 4,576,910 | 3/1986 | Hirano et al. | 430/381 |
| 4,594,313 | 6/1986 | Furutachi et al. | 430/381 |
| 4,657,846 | 4/1987 | Kokubo et al. | 430/588 X |
| 4,659,654 | 4/1987 | Metoki et al. | 430/588 X |

*Primary Examiner*—Mukund J. Shah

*Attorney, Agent, or Firm*—Sughrue, Mion, Zinn, Macpeak, and Seas

[57] ABSTRACT

A method for processing a silver halide color photographic material by fixing or bleach-fixing the material and immediately thereafter subjecting it to washing or stabilization, wherein (A) the silver halide color photographic material contains at least one of sensitizing dyes represented by the formulae (I) and (II) specified in the specification and at least one two-equivalent magenta polymer coupler which is derived from a specified monomer coupler, and (B) the amount of a replenisher in the washing step and/or the stabilization step falls within the range of 3 to 50 times, based on unit area of the material after being processed, the amount of each processing solution having been carried over from the preceding bath.

15 Claims, No Drawings

METHOD FOR PROCESSING SILVER HALIDE COLOR PHOTOGRAPHIC MATERIALS CONTAINING SENSITIZING DYES AND TWO-EQUIVALENT MAGENTA POLYMER COUPLERS

FIELD OF THE INVENTION

The present invention relates to a method for processing silver halide color photographic materials and, more particularly, to a method for processing silver halide color photographic materials which is free from an increase of Dmin (minimum density) which may occur when the amount of a processing solution used in the washing step and/or a stabilization bath is reduced more noticeably than that as has heretofore been used.

BACKGROUND OF THE INVENTION

The processing step of silver halide photographic materials generally includes a washing step. It has recently been suggested to reduce the amount of water used in the washing step in view of the requirements for prevention of environmental pollution, economization of water resources and reduction of manufacture cost. For instance, S. R. Goldwasser has proposed in his report of "Water Flow Rates in Immersion Washing of Motion Picture Film" in *Journal of the Society of Motion Picture and Television Engineers,* Vol. 64, pp. 248–253 (May, 1955), a method for the reduction of the amount of water used in the washing step by the use of multistage washing tanks where water is run in a countercurrent flow system. This method has been employed in various kinds of automatic developing machines as an effective means for economization of the amount of water.

Apart from this, other methods have been proposed where a stabilizing solution to which various chemicals are added is used in place of the washing step with only water so as to reduce the amount of the processing solution used in the washing step, as described in Japanese patent application (OPI) Nos. 8542/82, 14834/83, 132146/82, 18631/83, and 184345/84. The term "OPI" as used herein means an "unexamined and published application".

However, all of the above-mentioned methods are so defective that the reduction of the amount of the processing solution used results in an increase of Dmin of the photographic material after processing.

The cause of the defect is, first of all, a so called color stain of a sensitizing dye incorporated in the photographic material wherein the dye cannot sufficiently be washed out from the material because of the small amount of water used in the washing step thereby remaining in the film of the material after being processed.

In general, two factors are considered to determine the color stain of the sensitizing dye: (i) one is that the dye is decolored by the reaction with sodium sulfite contained in the developer and (ii) the other is that the dye is taken out of the emulsion layer in the washing step.

However, both of these two factors have a close relation to the structure of the dye used and, therefore, it was extremely difficult to selectively use such a dye that is less in color stain without adversely affecting other important photographic characteristics such as sensitivity, spectral sensitivity, etc.

SUMMARY OF THE INVENTION

Accordingly, one object of the present invention is to provide a method for processing silver halide color photographic materials where the amount of water used can noticeably be reduced and, at the same time, the variation of Dmin of the material after being processed can be suppressed.

Another object of the present invention is to provide a method for processing silver halide color photographic materials where the amount of a replenisher added can be reduced without deteriorating sharpness of the material.

In order to attain these objects, the present invention provides a new method for processing a silver halide color photographic material by fixing or bleach-fixing the material and immediately thereafter subjecting it to washing or stabilization, wherein (A) the silver halide color photographic material contains at least one of sensitizing dyes represented by the following formulae (I) and (II) and at least one two-equivalent magenta polymer coupler which is derived from a monomer coupler of the following formula (III) and which has a repeating unit represented by the following formula (IV), and (B) the amount of a replenisher in the washing step and/or the stabilization step falls within the range of 3 to 50 times, based on unit area of the material after being processed, the amount of each processing solution having been carried over from the preceding bath:

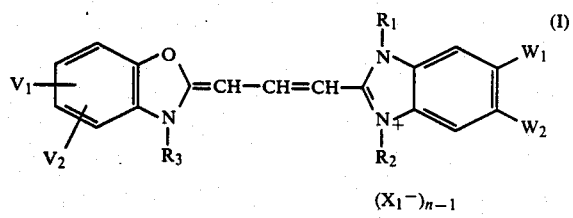

wherein $V_1$ and $V_2$ each represents a hydrogen atom, an alkyl group, an alkoxy group, a chlorine atom, a phenyl group, a substituted phenyl group, or a hydroxyl group, or $V_1$ and $V_2$ may together form a condensed benzene ring; $W_1$ represents a hydrogen atom, a fluorine atom, or chlorine atom; $W_2$ represents a hydrogen atom, a fluorine atom, an acyl group, an alkoxycarbonyl group, a sulfamoyl group, a cyano group, a fluorine-substituted alkyl group, or an alkylsulfonyl group; $R_1$, $R_2$, and $R_3$, which may be the same or different, each represents an alkyl group or a substituted alkyl group, with the proviso that at least one of $R^2$ and $R^3$ represents a substituted alkyl group having a sulfo group or a carboxyl group; $X_1$ represents an acid anion; and n is 1 or 2;

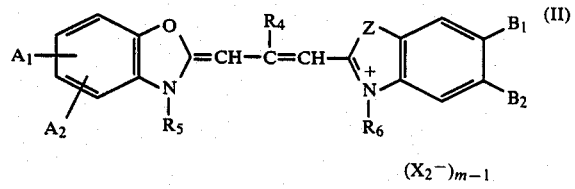

wherein Z represents a sulfur atom or a selenium atom; $A_1$ and $A_2$, which may be the same or different, each has the same meanings as in $V_1$ or $V_2$ in the formula (I); $B_1$ represents a hydrogen atom, a lower alkyl group, a lower acylamino group, or a lower alkoxy group; when $B_1$ is a hydrogen atom, $B_2$ represents a lower acylamino group, a lower alkoxycarbonyl group, or a carboxyl group, when $B_1$ is a lower alkoxy group, $B_2$ additionally represents a lower alkyl group, a lower acylamino group, a chlorine atom, a substituted or unsubstituted phenyl group, a hydroxyl group, a lower alkoxycarbonyl group, or a carboxyl group, and when $B_1$ is a lower alkyl group or a lower acylamino group, $B_2$ additionally represents a lower alkoxy group; $R_4$ represents a hydrogen atom, a lower alkyl group, or an aralkyl group; $R_5$ and $R_6$ each has the same meanings as in $R_1$, $R_2$, or $R_3$ in the formula (I); $X_2$ represents an acid anion residue; and m is 1 or 2;

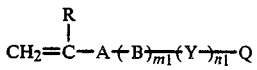

(III)

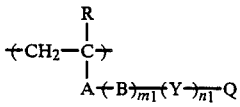

(IV)

wherein R represents a hydrogen atom, a lower alkyl group having 1 to 4 carbon atoms, or a chlorine atom; A represents —CONH—, —COO—, —O—, or a phenylene group; B represents a substituted or unsubstituted alkylene group which may be straight or branched chain, a substituted or unsubstituted aralkylene group, or a substituted or unsubstituted phenylene group; Y represents —CONH—, —NHCONH—, —NHCO—, —COO—, —$SO_2$—, —CO—, or —O—; $n_1$ is 0 or 1; when $n_1$ is 0, $m_1$ is 1, and when $n_1$ is 1, $m_1$ is 1; and Q represents a two-equivalent magenta coupler residue capable of forming a dye upon coupling with an oxidation product of an aromatic primary amine developing agent.

DETAILED DESCRIPTION OF THE INVENTION

The phase "the amount of the processing solution having been carried over from the preceding bath" as used herein means the volume of the processing solution from the preceding bath that is adhered to and contained in the unit area of the photographic material after being processed.

This amount can be calculated as follows: The photographic material after being processed is taken out just before it is to be introduced into the next bath and then dipped in distilled water to extract the component of the preceding bath. The extracted component is then measured. Further, the measurement of the component of the preceding bath, a component that is highly stable to oxidation or a like reaction in the step of extraction is to be selected.

The sensitizing dye which can be used in the present invention is at least one of compounds represented by the above-described formulae (I) and (II) and will be hereunder explained in greater detail.

First of all, the formula (I) is explained.

$V_1$ and $V_2$ each represents a hydrogen atom, an alkyl group (those having 1 to 8 carbon atoms, such as a methyl group, an ethyl group, a propyl group, a butyl group, etc.), an alkoxy group (those having 1 to 8 atoms, such as a methoxy group, an ethoxy group, a propoxy group, a butoxy group, etc.), a chlorine atom, a phenyl group, a substituted phenyl group (such as a tolyl group, an anisyl group, a p-chlorophenyl group, etc.), or a hydroxyl group. In particular, 5-position substituted compounds are preferred. Further, $V_1$ and $V_2$ may together form a condensed benzene ring (such as a 4,5-benzo ring, etc.).

$W_1$ represents a hydrogen atom, a fluorine atom, or a chlorine atom; and $W_2$ represents a hydrogen atom, a fluorine atom, an acyl group (those having 8 or less carbon atoms, such as an acetyl group, a benzoyl group, etc.), an alkoxycarbonyl group (those having 8 or less carbon atoms, such as a methoxycarbonyl group, an ethoxycarbonyl group, a benzyloxycarbonyl group, etc.), a sulfamoyl group (such as a sulfamoyl group, an N,N-dimethylsulfamoyl group, a morpholinosulfonyl group, a piperidinosulfonyl group, etc.), a cyano group, a fluorine-substituted alkyl group (those having 1 to 4 carbon atoms, such as a trifluoromethyl group, a difluoromethyl group, a 2,2,2-trifluoroethyl group, a 1,1,2,2-tetrafluoroethyl group, etc.), or an alkylsulfonyl group (those having 1 to 4 carbon atoms, such as a methanesulfonyl group, an ethanesulfonyl group, etc.). $R_1$, $R_2$, and $R_3$ may be the same or different and each represents an alkyl group (those having 8 or less carbon atoms, such as a methyl group, an ethyl group, a propyl group, an allyl group, a butyl group, a pentyl group, a cyclohexyl group, etc.) or a substituted alkyl group (in which the alkyl moiety thereof has 6 or less, preferably 4 or less, carbon atoms and is substituted by one or more substituents selected from a carboxyl group, sulfo group, a cyano group, a halogen atom (such as a fluorine atom, a chlorine atom, a bromine atom, etc.), a hydroxyl group, an alkoxycarbonyl group (those having 8 or less carbon atoms, such as a methoxycarbonyl group, an ethoxycarbonyl group, a benzyloxycarbonyl group, etc.), an alkoxy group (those having 7 or less carbon atoms, such as a methoxy group, an ethoxy group, a propoxy group, a butoxy group, a benzyloxy group, etc.), an aryloxy group (such as a phenoxy group, a p-tolyloxy group, etc.), an acyloxy group (those having 3 or less carbon atoms, such as an acetyloxy group, a propionyloxy group, etc.), an acyl group (those having 8 or less carbon atoms, such as an acetyl group, a propionyl group, a benzoyl group, etc.), an alkylsulfonyl group (those having 4 or less carbon atoms, such as a mesyl group, etc.), a carbamoyl group (such as a carbamoyl group, an N,N-dimethylcarbamoyl group, a morpholinocarbamoyl group, a piperdinocarbamoyl group, etc.), a sulfamoyl group (such as a sulfamoyl group, an N,N-dimethylsulfamoyl group, a morpholinosulfonyl group, a piperidinosulfonyl group, etc.), and an aryl group (such as a phenyl group, a p-hydroxyphenyl group, a p-carboxyphenyl group, a p-sulfophenyl group, an α-naphthyl group, etc.).

At least one of $R_2$ and $R_3$ represents a substituted alkyl group having a sulfo group or a carboxyl group in the substituent(s). More preferably, both of $R_2$ and $R_3$ are substituted alkyl groups having a sulfo group or a carboxyl group. $X_1$ represents an acid anion; and when the sensitizing dye of the formula (I) forms an intramolecular salt, n is 1, and in other cases, n is 2.

$W_2$ is especially preferably a cyano group or a trifluoromethyl group; and $V_1$ and $V_2$ is especially preferably a 5-positioned phenyl group or chlorine atom, or these preferably form a condensed benzene ring.

Next, the formula (II) is explained.

Z represents a sulfur atom or a selenium atom; and $A_1$ and $A_2$ may be the same or different and each has the same meanings as in $V_1$ or $V_2$ in the formula (I).

$B_1$ represents a hydrogen atom, a lower alkyl group (those having 5 or less carbon atoms, such as a methyl group, an ethyl group, a propyl group, a pentyl group, etc.), a lower acylamino group (those having 5 or less carbon atoms, such as an acetylamino group, a propionylamino group, a valerylamino group, etc.), or a lower alkoxy group (those having 4 or less carbon atoms, such as a methoxy group, an ethoxy group, a butoxy group, etc.).

When $B_1$ is a hydrogen atom, $B_2$ represents a lower acylamino group (those having 5 or less carbon atoms, such as an acetylamino group, a propionylamino group, etc.), a lower alkoxycarbonyl group (those having 6 or less carbon atoms, such as a methoxycarbonyl group, an ethoxycarbonyl group, a butoxycarbonyl group, etc.), or a carboxyl group.

When $B_1$ is a lower alkoxy group, $B_2$ represents, in addition to the above-mentioned substituent of $B_2$, a lower alkyl group (those having 5 or less carbon atoms, such as a methyl group, an ethyl group, a butyl group, etc.), a lower acylamino group (those having 5 or less carbon atoms, such as an acetylamino group, a propionylamino group, etc.), a chlorine atom, a substituted or unsubstituted phenyl group (those having 10 or less carbon atoms, such as a phenyl group, a p-chlorophenyl group, an anisyl group, a tolyl group, etc.), a hydroxyl group, a lower alkoxycarbonyl group (those having 5 or less carbon atoms, such as a methoxycarbonyl group, an ethoxycarbonyl group, etc.), or a carboxyl group.

When $B_1$ is a lower alkyl group or a lower acylamino group, $B_2$ represents a lower alkoxy group (those having 5 or less carbon atoms, such as a methoxy group, an ethoxy group, a butoxy group, etc.), in addition to the substituent of $B_2$ as mentioned for the case of $B_1$ being a lower alkoxy group.

$R_4$ represents a hydrogen atom, a lower alkyl group (those having 4 or less carbon atoms, such as a methyl group, an ethyl group, a propyl group, etc.), or an aralkyl group (those having 10 or less carbon atoms, such as a phenethyl group).

$R_5$ and $R_6$ each has the same meaning as in $R_1$, $R_2$, or $R_3$ in the formula (I), provided that at least one of $R_5$ and $R_6$ represents an alkyl group containing a sulfo group or a carboxyl group.

$X_2$ represents an acid anion residue; and m is 1 or 2.

One of $A_1$ and $A_2$ is especially preferably a 5-positioned phenyl group, chlorine atom, methoxy group or ethoxy group, with the other being a hydrogen atom, or these especially preferably form a 5,6- or 6,7-condensed benzene ring. B is especially preferably a methyl group, an ethyl group, a methoxy group, an ethoxy group, an acetylamino group, or a propionylamino group; and $B_2$ is especially preferably a methyl group, an ethyl group, an acetylamino group, a propionylamino group, or a chlorine atom. $R_4$ is especially preferably an ethyl group or a propyl group.

Examples of the sensitizing dyes as represented by the formulae (I) and (II) are given below, which, however, are not whatsoever limitative.

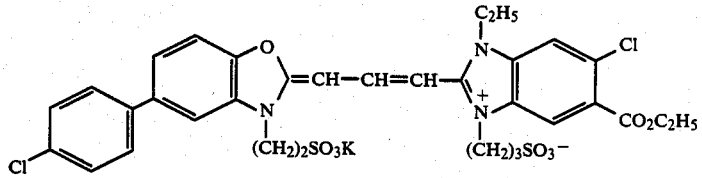

I-1

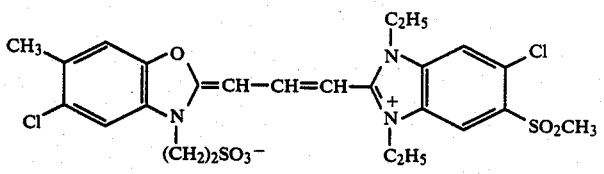

I-2

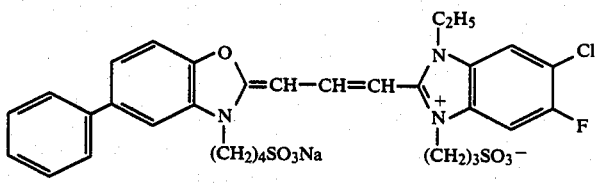

I-3

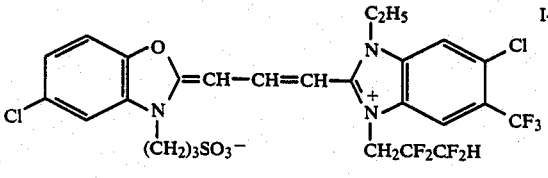

I-4

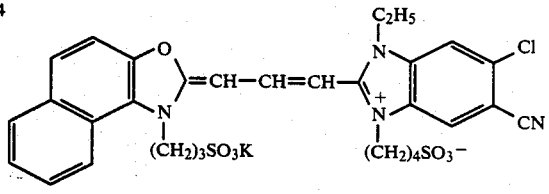

I-5

-continued
I-6
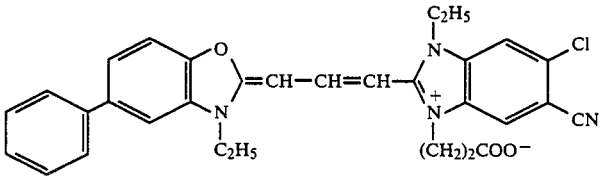
I-7
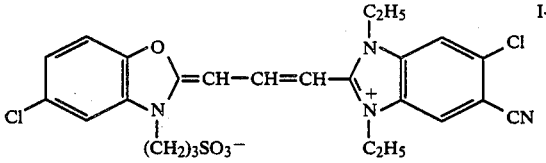
I-8
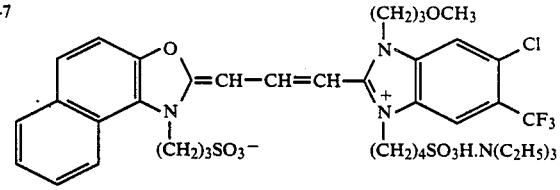
I-9
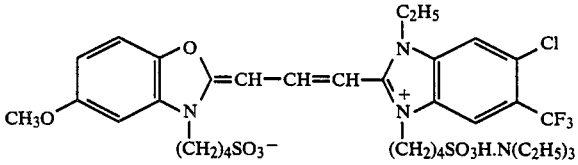
I-10
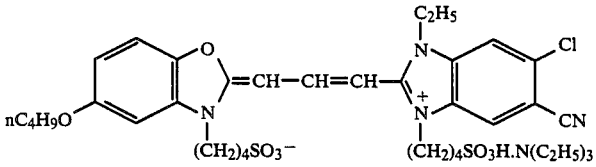
I-11
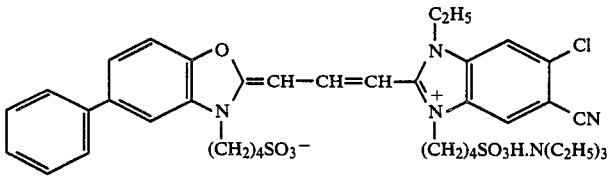
I-12
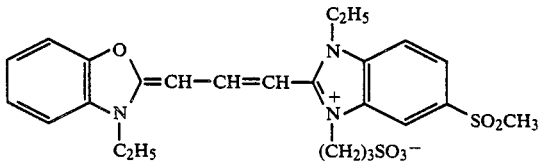
I-13
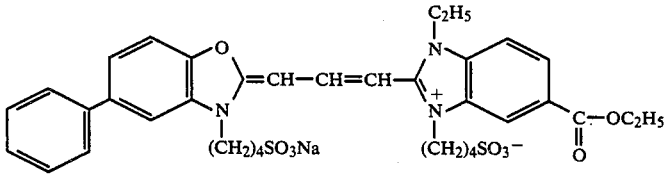
I-14
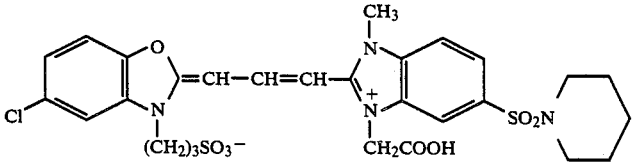
II-1
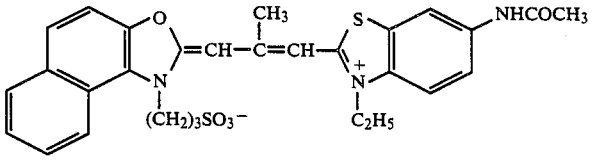

-continued

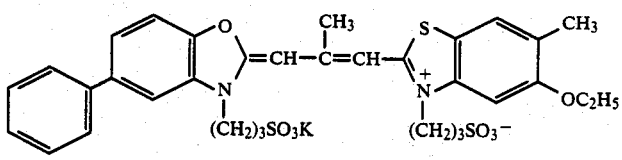

II-2

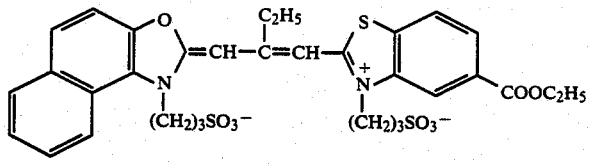

II-3

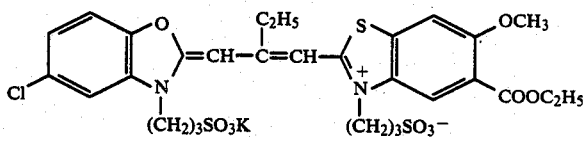

II-4

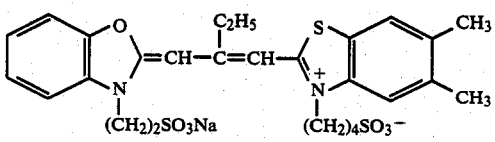

II-5

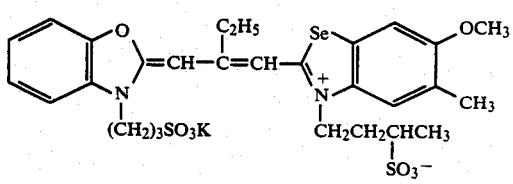

II-6

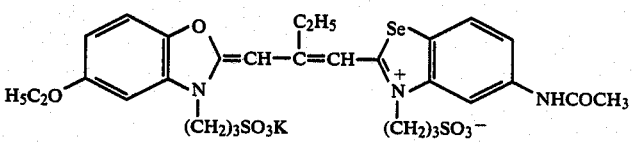

II-7

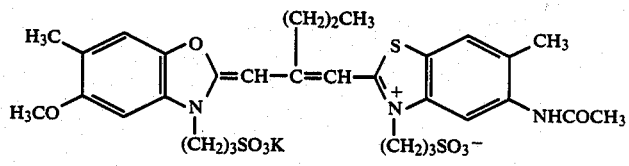

II-8

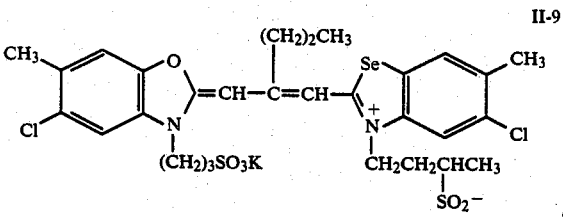

II-9

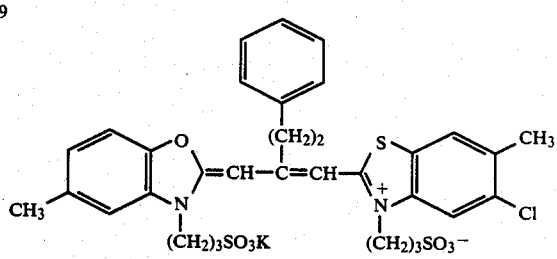

II-10

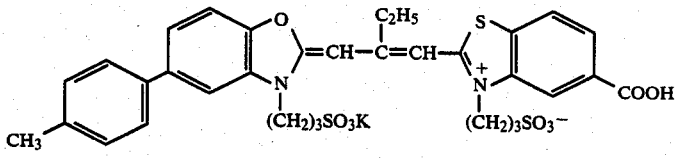

II-11

Next, the formulae (III) and (IV) are explained.

R represents a hydrogen atom, a lower alkyl group having 1 to 4 carbon atoms, or a chlorine atom; A represents —CONH—, —COO—, —O—, or a phenylene group; B represents a substituted or unsubstituted alkylene group which may be straight or branched chain, a substituted or unsubstituted aralkylene group, or a substituted or unsubstituted phenylene group; Y represents —CONR'—, —NR'CONR'—, —NR'$CO_2$—, —NR'CO—, —OCONR'—, —NR'—, —$CO_2$—, —OCO—, —CO—, —O—, —$SO_2$—, —NR'$SO_2$—, —$SO_2$NR'—, or —S—, wherein R' represents a hydrogen atom, a substituted or unsubstituted aliphatic group, or a substituted or unsubstituted aryl group, provided that wherein two or more of R' are present in the molecule, they may be the same or different; $n_1$ is 0 or 1; and when $n_1$ is 0, $m_1$ is 1, and when $n_1$ is 1, $m_1$ is 1.

Q represents a two-equivalent magenta coupler residue capable of forming a dye upon coupling with an oxidation product of an aromatic primary amine developing agent and is preferably a residue of a 5-pyrazolone of the following formula (V) or (VI) or a residue of a pyrazoloazole of the formula (VII) as given hereinafter.

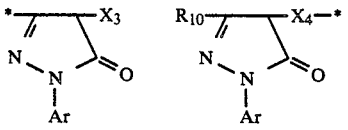

(V) (VI)

In the formulae (V) and (VI), Ar represents an alkyl group, a substituted alkyl group (such as a fluoroalkyl group or the like haloalkyl group, a cyanoalkyl group, a benzylalkyl group, etc.), an aryl group, or a substituted aryl group having one or more substituents selected from an alkyl group (such as a methyl group, an ethyl group, etc.), an alkoxy group (such as a methoxy group, an ethoxy group, etc.), an aryloxy group (such as a phenyloxy group, etc.), an alkoxycarbonyl group (such as a methoxycarbonyl group, etc.), an acylamino group (such as an acetylamino group), a carbamoyl group, an alkylcarbamoyl group (such as a methylcarbamoyl group, an ethylcarbamoyl group, etc.), a dialkylcarbamoyl group (such as a dimethylcarbamoyl group), an arylcarbamoyl group (such as a phenylcarbamoyl group), an alkylsulfonyl group (such as a methylsulfonyl group), an arylsulfonyl group (such as a phenylsulfonyl group), an alkylsulfonamido group (such as a methanesulfonamido group), an arylsulfonamido group (such as a phenylsulfonamido group), a sulfamoyl group, an alkylsulfamoyl group (such as an ethylsulfamoyl group), a dialkylsulfamoyl group (such as a dimethylsulfamoyl group), an alkylthio group (such as a methylthio group), an arylthio group (such as a phenylthio group), a cyano group, a nitro group, and a halogen atom (such as a fluorine atom, a chlorine atom, a bromine atom, etc.). In the case that the aryl group is substituted by two or more substituents, these substituents may be the same or different.

When Ar represents a substituted aryl group, preferred substituents therefor are a halogen atom, an alkyl group, an alkoxy group, an alkoxycarbonyl group, and a cyano group, with the halogen atom being most preferred.

$R_{10}$ represents a substituted or unsubstituted anilino group, a substituted or unsubstituted acylamino group (such as an alkylcarbonamido group, a phenylcarbonamido group, an alkoxycarbonamido group, or a phenyloxycarbonamido group), or a substituted or unsubstituted ureido group (such as an alkylureido group or a phenylureido group). Examples of the substituent include a halogen atom (such as a fluorine atom, a chlorine atom, a bromine atom, etc.), a linear, branched or cyclic alkyl group (such as a methyl group, a t-butyl group, an octyl group, a tetradecyl group, a cyclohexyl group, etc.), an alkoxy group (such as a methoxy group, an ethoxy group, a 2-ethylhexyloxy group, a tetradecyloxy group, etc.), an acylamino group (such as an acetamido group, a benzamido group, a butanamido group, an octanamido group, a tetradecanamido group, an α-(2,4-di-tert-amylphenoxy)acetamido group, an α-(2,4-di-tert-amylphenoxy)butylamido group, an α-(3-pentadecylphenoxy)hexanamido group, an α-(4-hydroxy-3-tert-butylphenoxy)tetradecanamido group, a 2-oxo-pyrrolidin-1-yl group, a 2-oxo-5-tetradecylpyrrolidin-1-yl group, an N-methyl-tetradecanamido group, etc.), a sulfonamido group (such as a methanesulfonamido group, a benzenesulfonamido group, an ethylsulfonamido group, a p-toluenesulfonamido group, an octanesuflonamido group, a p-dodecylbenzenesulfonamido group, an N-methyl-tetradecanesulfonamido group, etc.), a sulfamoyl group (such as a sulfamoyl group, an N-methylsulfamoyl group, an N-ethylsulfamoyl group, an N,N-dimethylsulfamoyl group, an N,N-dihexylsulfamoyl group, an N-hexadecylsulfamoyl group, an N-[3-(dodecyloxy)propyl]sulfamoyl group, an N-[4-(2,4-di-tert-amylphenoxy)butyl]sulfamoyl group, an N-methyl-N-tetradecylsulfamoyl group, etc.), a carbamoyl group (such as an N-methylcarbamoyl group, an N-butylcarbamoyl group, an N-octadecylcarbamoyl group, an N-[4-(2,4-di-tert-amylphenoxy)-butyl]carbamoyl group, an N-methyl-N-tetradecylcarbamoyl group, etc.), a diacylamino group (such as an N-succinimido group, an N-phthalimido group, a 2,5-dioxo-1-oxazolidinyl group, a 3-dodecyl-2,5-dioxo-1-hydantoinyl group, a 3-(N-acetyl-N-dodecylamino)succinimido group, etc.), an alkoxycarbonyl group (such as a methoxycarbonyl group, a tetradecyloxycarbonyl group, a benzyloxycarbonyl group, etc.), an alkoxysulfonyl group (such as a methoxysulfonyl group, a butoxysulfonyl group, an octyloxysulfonyl group, a tetradecyloxysulfonyl group, etc.), an aryloxysulfonyl group (such as a phenoxysulfonyl group, a p-methylphenoxysulfonyl group, a 2,4-di-tert-amylphenoxysulfonyl group, etc.), an alkanesulfonyl group (such as a methanesulfonyl group, an ethanesulfonyl group, an octanesulfonyl group, a 2-ethylhexylsulfonyl group, a hexadecanesulfonyl group, etc.), an arylsulfonyl group (such as a benzenesulfonyl group, a 4-nonylbenzenesulfonyl group, etc.), an alkylthio group (such as a methylthio group, an ethylthio group, a hexylthio group, a benzylthio group, a tetradecylthio group, a 2-(2,4-di-tert-amylphenoxy)ethylthio group, etc.), an arylthio group (such as a phenylthio group, a p-tolylthio group, etc.), an alkyloxycarbonylamino group (such as a methoxycarbonylamino group, an ethyloxycarbonylamino group, a benzyloxycarbonylamino group, a hexadecyloxycarbonylamino group, etc.), an alkylureido group (such as an N-methylureido group, an N,N-dimethylureido group, an N-methyl-N-dodecylureido group, an N-hexadecylureido group, an N,N-dioctadecylureido group, etc.), an acyl group (such as an acetyl group, a benzoyl group, an octadecanoyl group, a p-dodecanamidobenzoyl group, etc.), a nitro group, a carboxyl group, a sulfo group, a hydroxyl group, and a trichloromethyl group.

In the above-mentioned substituents, the alkyl group has 1 to 36 carbon atoms; and the aryl group has 6 to 38 carbon atoms.

$X_3$ represents a coupling split-off group bonded to the coupling position of the molecule via a nitrogen atom, a sulfur atom, or an oxygen atom; and the atom is bonded to an alkyl group, an aryl group, an alkylsulfonyl group, an arylsulfonyl group, an alkylcarbonyl group, an arylcarbonyl group, or a heterocyclic group, in which the alkyl group, aryl group, and heterocyclic group may have substituent(s) as referred to in the substituted aryl group of the above-mentioned Ar. In the case that the group is bonded via a nitrogen atom, this may form, together with the nitrogen atom, a heterocyclic ring as a split-off group, such as an imidazolyl group, a pyrazolyl group, a triazolyl group, a tetrazolyl group, etc.

Especially preferred split-off groups are a nitrogen atom split-off group in which a heterocyclic ring such as an imidazolyl group, a pyrazolyl group, etc. is formed.

$X_4$ represents a divalent free radical derived from $X_3$ by removing one hydrogen atom.

The asterisk "*" means a position to which $-(Y)_{m1}$ in the formula (III) or (IV) bonds.

The polymer coupler of the present invention may be a homopolymer of the monomer coupler of the formula (III), or copolymers of two or more of the monomer couplers of the formula (III), or copolymers comprising the monomer coupler of the formula (III) and other non-color-forming ethylenic monomer which is not coupled with an oxidation product of an aromatic primary amine developing agent. In the last case, the copolymer may comprise two or more of the monomer couplers of the formula (III).

Among them, copolymers comprising the monomer coupler of the formula (III) and other non-color-forming monomer as exemplified hereunder are particularly preferred.

Examples of ethylenic monomers which do not undergo color formation upon coupling with the oxidation product of an aromatic primary amine developing agent include an acrylic acid (e.g., acrylic acid, α-chloroacrylic acid, α-alkylsubstituted acrylic acid (e.g., methacrylic acid, etc.), etc.), an ester or an amide derived from an acrylic acid (e.g., acrylamide, methacrylamide, n-butylacrylamide, tertbutylacrylamide, diacetoneacrylamide, methylenebisacrylamide, methyl acrylate, ethyl acrylate, n-propyl acrylate, n-butyl acrylate, tert-butyl acrylate, isobutyl acrylate, 2-ethylhexyl acrylate, n-octyl acrylate, lauryl acrylate, methyl methacrylate, ethyl methacrylate, n-butyl methacrylate, β-hydroxyethyl methacrylate, etc.), a vinyl ester (e.g., vinyl acetate, vinyl propionate, vinyl laurate, etc.), acrylonitrile, methacrylonitrile, an aromatic vinyl compound (e.g., styrene and a derivative thereof, vinyltoluene, divinylbenzene, vinylacetophenone, sulfostyrene, etc.), itaconic acid, citraconic acid, crotonic acid, vinylidene chloride, a vinylalkyl ether (e.g., vinylethyl ether, etc.), a maleic acid ester, N-vinyl-2-pyrrolidone, N-vinylpyridine, 2- or 4-vinylpyridine, etc, with acrylic acid esters, methacrylic acid esters and maleic acid esters being preferred.

Two or more non-color-forming ethylenically unsaturated monomers can be used together. For instance, combinations of methyl acrylate and butyl acrylate, butyl acrylate and styrene, butyl methacrylate and methacrylic acid, and methyl acrylate and diacetone acrylamide can be used in the present invention.

As is well known in the field of polymer couplers, the ethylenically unsaturated monomers to be copolymerized with the monomer coupler corresponding to the formula (III) can be so selected that physical properties and/or chemical properties of the copolymer to be formed, such as solubility, compatibility of photographic colloid compositions with binders (e.g., gelatin), flexibility and heat-stability thereof, etc., are advantageously affected.

The magenta polymer coupler used in the present invention is preferably treated as a latex thereof in the manufacture step of photographic material. The latex may be formed by dissolving an oleophilic polymer coupler obtained by polymerization of the monomer coupler in an organic solvent and then emulsifying and dispersing the solution in a gelatin aqueous solution in the latex form or, alternatively, may be formed by means of a direct emulsion polymerization method.

The method for the emulsification and dispersion of the oleophilic polymer coupler in a gelatin aqueous solution in the latex form is described in U.S. Pat. No. 3,451,820; and the direct emulsion polymerization is described in U.S. Pat. Nos. 4,080,211 and 3,370,952.

The synthesis of the magenta polymer coupler of the present invention is carried out by using the compounds as described in Japanese patent application (OPI) Nos. 5543/81, 94752/82, 176038/82, 204038/82, 28745/83, 10738/83, 42044/83, 145944/83, 224352/83, and 42543/84, as a polymerization initiator or a polymerization solvent.

The polymerization temperature is determined depending upon the molecular weight of the polymer to be formed and the kind of initiator used and can be selected from 0° C. to 100° C. or higher but usually within the range of from 30° C. to 100° C.

The proportion of the color forming portion corresponding to the formula (III) which is occupied in the copolymer coupler is, in general, desired to fall within the range of from 5 to 80% by weight and, in particular, the proportion thereof is preferably within the range of from 20 to 70% by weight in view of the color reproductivity, colorability and stability. In this case, the equimolecular amount (or the number of grams of the polymer containing one mole of the monomer coupler) is about 250 to 4000 which is, however, not limitative.

Preferred examples of the two-equivalent 5-pyrazolone type magenta polymer couplers which can be used in the present invention are given hereunder, which are, however, not limitative.

MC-1
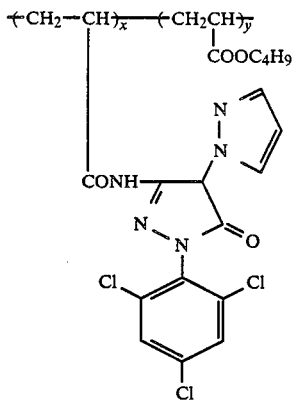
x/y = 50/50 (wt)
MC-2
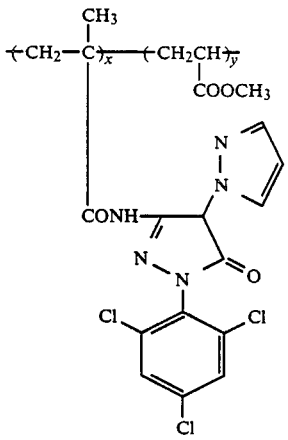
x/y = 50/50 (wt)
MC-3
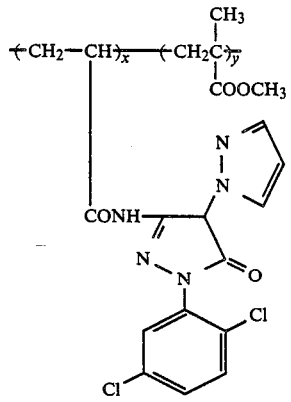
x/y = 60/40 (wt)
MC-4
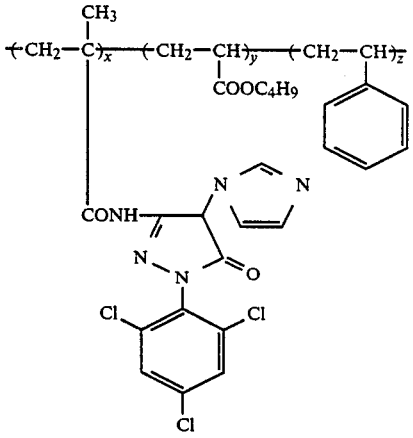
x/y/z = 50/25/25 (wt)
M-5
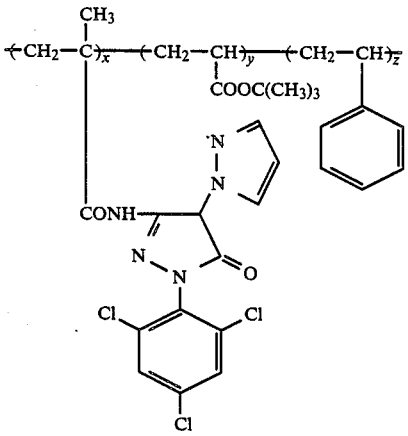
x/y/z = 50/25/25 (wt)
MC-6
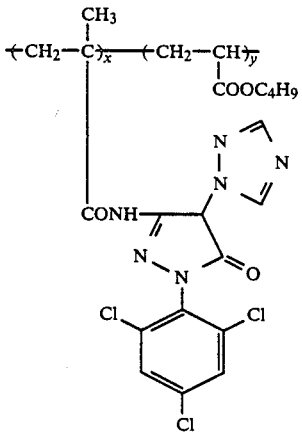
x/y = 50/50 (wt)

-continued
MC-7
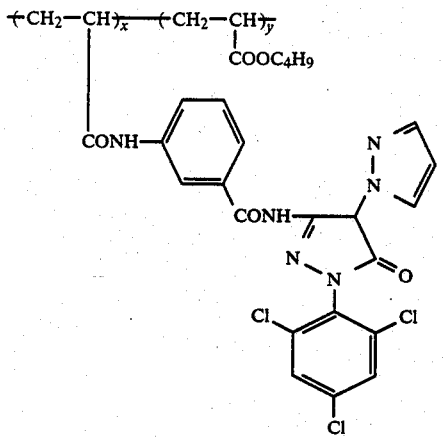
x/y = 70/30 (wt)
MC-8
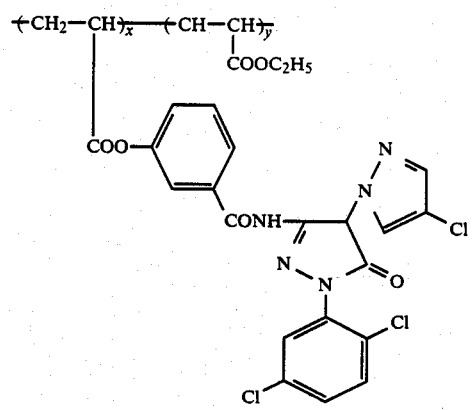
x/y = 70/30 (wt)
MC-9
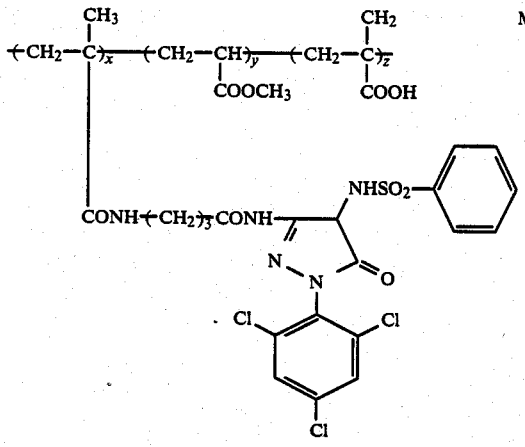
x/y/z = 60/35/5 (wt)
MC-10
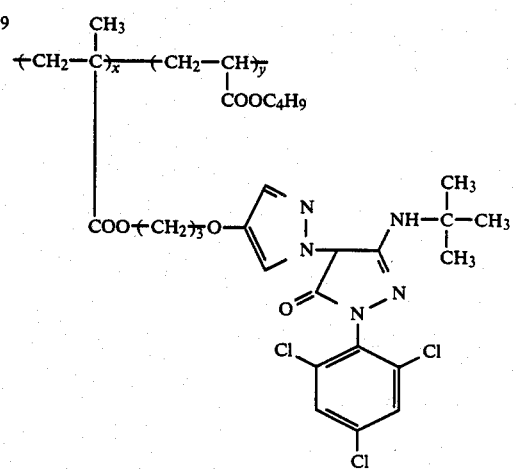
x/y = 70/30
MC-11
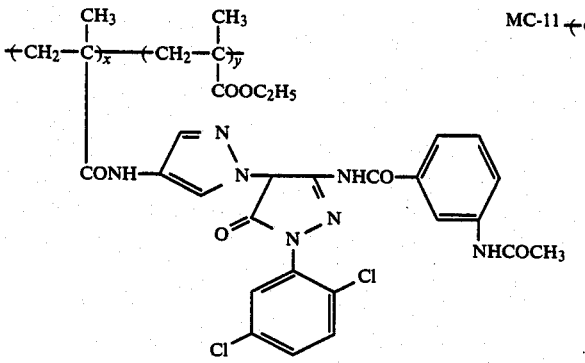
x/y = 50/50 (wt)
MC-12
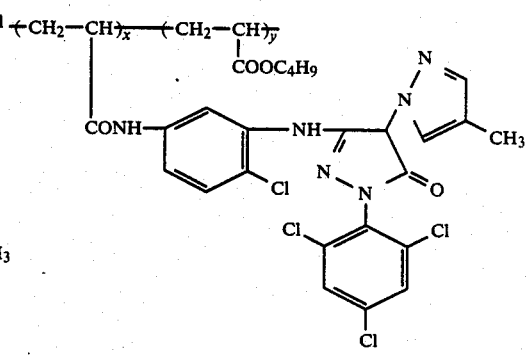
x/y = 40/60 (wt)

-continued
MC-13
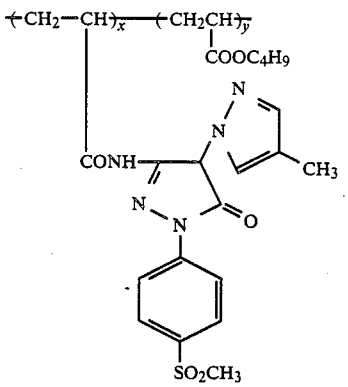
x/y = 50/50 (wt)
MC-14
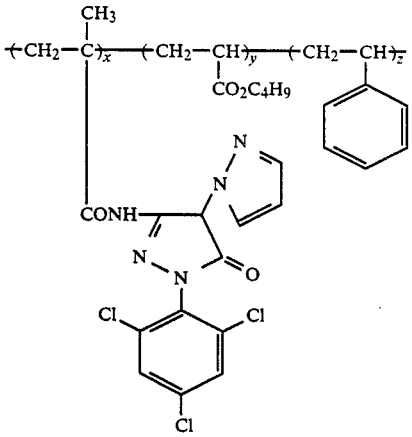
x/y/z = 50/25/25 (wt)
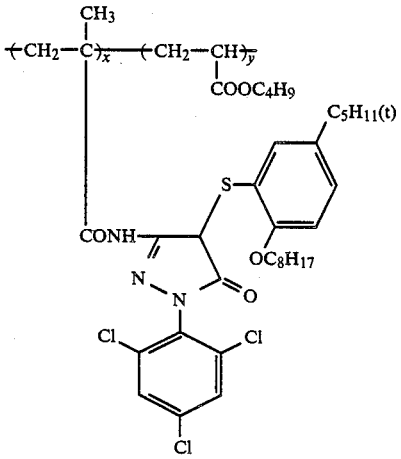
x/y = 50/50 (wt)
MC-15
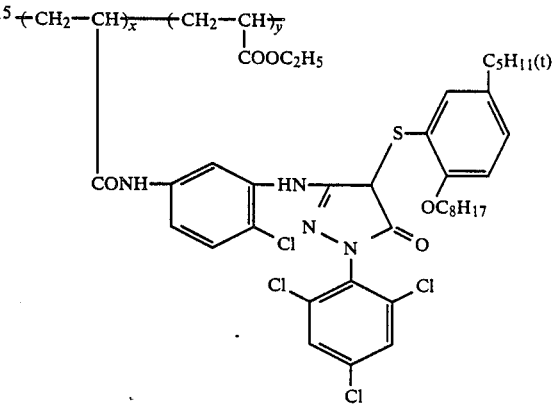
MC-16
x/y = 50/50 (wt)
MC-17
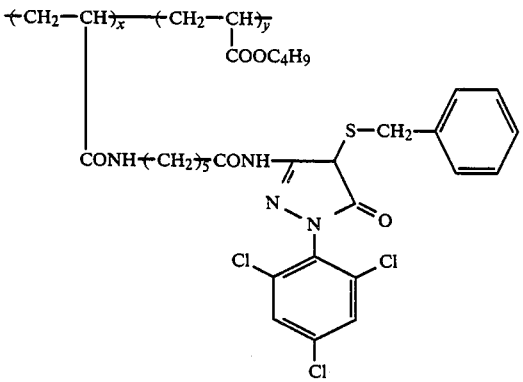
x/y = 65/35 (wt)

-continued

MC-18

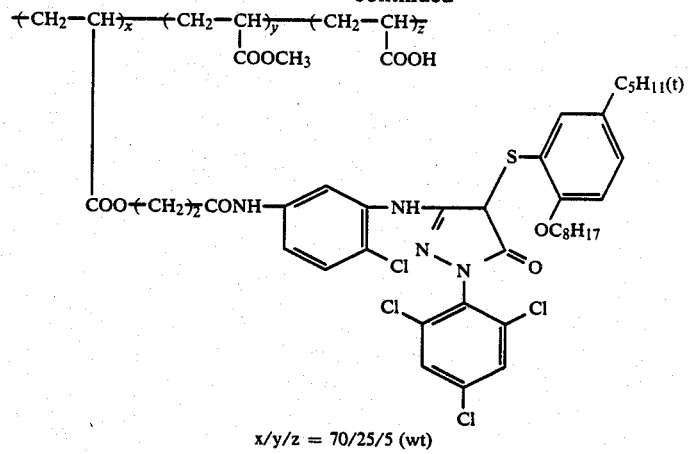

x/y/z = 70/25/5 (wt)

MC-19

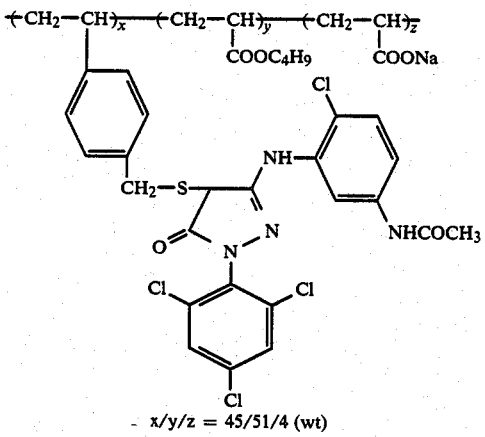

x/y/z = 45/51/4 (wt)

MC-20

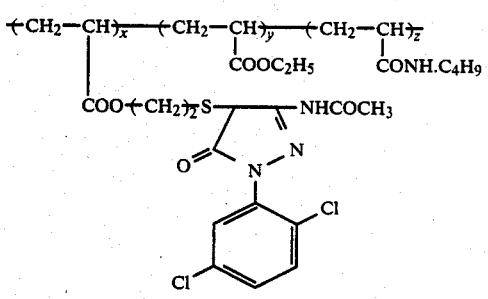

x/y/z = 50/30/20 (wt)

MC-21

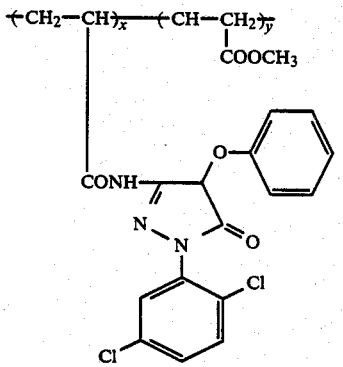

x/y = 50/50 (wt)

MC-22

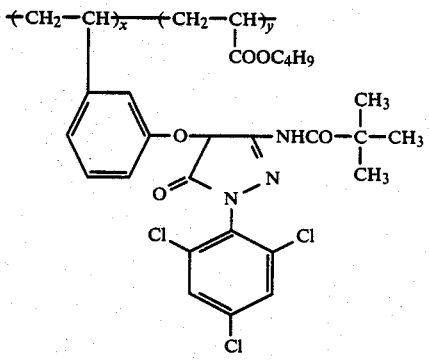

x/y = 60/40 (wt)

Formula (VII):

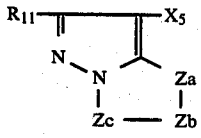

(VII)

wherein $R_{11}$ represents a hydrogen atom or an organic substituent; $X_5$ represents a group to be cleaved and removed upon a coupling reaction with an oxidization product of an aromatic primary amine developing agent (which is referred to as a coupling split-off group or a split-off group); and Za, Zb and Zc each represents a methine group, a substituted methine group, =N—, or —NH—, with one of the Za—Zb bond and the Zb—Zc bond being a double bond and the other being a single bond, and when Zb—Zc bond is a carbon-carbon double bond, this may be a part of an aromatic ring; and $R_{11}$, $X_5$ or a substituted methine group of Za, Zb or Zc may be a divalent group to bond to $—Y)_{n1}$ in the formula (III) or (IV).

The compound represented by the formula (VII) is a five member-five member condensed type nitrogen-containing heterocyclic coupler, and the coloring nucleus thereof has an isoelectronic aromaticity like naphthalene, and the chemical structure thereof corresponds to a so-called "azapentalene".

Preferred compounds among the couplers of the formula (VII) are the following six kinds of compounds (F-1) through (F-6):

(F-1): 1H-imidazo[1,2-b]pyrazoles (F-2): 1H-pyrazolo[1,5-b]pyrazoles
(F-3): 1H-pyrazolo[1,5-c][1,2,4]triazoles
(F-4): 1H-pyrazolo[1,5-b][1,2,4]triazoles
(F-5): 1H-pyrazolo[1,5-d]tetrazoles
(F-6): 1H-pyrazolo[1,5-a]benzimidazoles Among these compounds, those of (F-1), (F-3) and (F-4) are especially preferred and, in particular, those of (F-4) are most preferred.

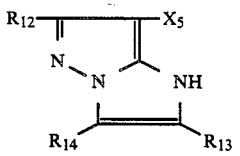
(F-1)

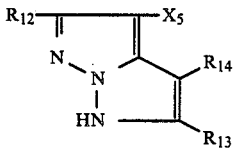
(F-2)

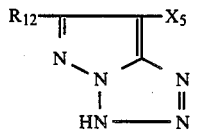
(F-3)

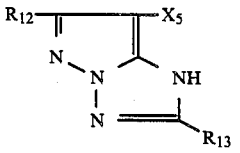
(F-4)

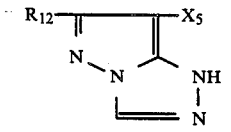
(F-5)

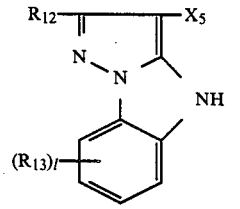
(F-6)

In the above formulae (F-1) through (F-6), $R_{12}$, $R_{13}$ and $R_{14}$ each represents an aliphatic hydrocarbon group or an aromatic or a heterocyclic group, each of which may be substituted. Substituents which are allowable for $R_{12}$ through $R_{14}$ are a halogen atom, an alkyl group, an alkenyl group, an aryl group, a heterocyclic group, an alkoxy group, an aryloxy group, an acyloxy group, a sulfonyloxy group, an acyl group, a sulfonyl group, a carboxyl group, a sulfo group, a hydroxyl group, an amino group, a carbonamido group, a sulfonamido group, a carbamoyl group, a sulfamoyl group, an alkoxycarbonyl group, an aryloxycarbonyl group, a ureido group, a sulfinyl group, an alkylthio group, an arylthio group, a cyano group, etc. In addition, $R_{12}$, $R_{13}$ and $R_{14}$ themselves may each be a hydrogen atom or a substituent selected from the above-mentioned substituents including a halogen atom and so on. $R_{12}$ through $R_{14}$ each is preferably an alkyl group, an aryl group, a carbonamido group, a sulfonamido group, or a ureido group, each of which may further have one or more of the above-mentioned substituents. The number of the carbon atoms contained in the aliphatic or heterocyclic substituent is preferably 1 to 22; and the number of carbon atoms contained in the aromatic substituent is 6 to 22.

In the formula (F-6), l represents an integer of from 0 to 4.

In the case that the formula (F-6) has two or more of the substituents $R_{13}$, these may be the same or different.

$X_5$ represents a coupling split-off group, such as, (1) a halogen atom; (2) a group capable of bonding an aliphatic group, an aromatic group, an heterocyclic group, an aliphatic, aromatic or heterocyclic group, or an aliphatic, aromatic or heterocyclic carbonyl group to the carbon atom of the coupling active site, via an oxygen atom, a nitrogen atom or a sulfur atom; or (3) an aromatic azo group. The aliphatic, aromatic or heterocyclic group contained in the split-off group may be substituted by the substituent(s) as referred to in the above-mentioned $R_{12}$, $R_{13}$ and $R_{14}$. In the case that the group is substituted by two or more substituents, these may be the same or different.

Specific examples of the split-off groups are a halogen atom (such as a fluorine atom, a chlorine atom, and a bromine atom), an alkoxy group (such as an ethoxy group, a dodecyloxy group, a methoxyethylcarbamoylmethoxy group, a carboxypropyloxy group, and a methanesulfonylethoxy group), an aryloxy group (such as a 4-chlorophenoxy group, a 4-methoxyphenoxy group, and a 4-carboxyphenoxy group), an acyloxy group (such as an acetoxy group, a tetradecanoyloxy group, and a benzoyloxy group), an aliphatic or aromatic sulfonyloxy group (such as a methanesulfonyloxy group and a toluenesulfonyloxy group), an acylamino group (such as a dichloroacetylamino group, a trifluoroacetylamino group, and a heptafluorobutyrylamino group), an aliphatic or aromatic sulfonamido group (such as a methanesulfonamido group and a p-toluenesulfonamido group), an alkoxycarbonyloxy group (such as an ethoxycarbonyloxy group and a benzyloxycarbonyloxy group), an aryloxycarbonyloxy group (such as a phenoxycarbonyloxy group), an aliphatic, aromatic or heterocyclic thio group (such as an ethylthio group and a phenylthio group), a carbamylamino group (such as an N-methylcarbamoylamino group and an N-phenylcarbamoylamino group), a 5-membered or 6-membered nitrogen-containing heterocyclic group (such as a 1-imidazolyl group, a 1-pyrazolyl group, a 1-triazolyl group, a 1-tetrazolyl group, and a 1,2-dihydro-2-oxo-1-pyridyl group), an imido group (such as a succinimido group and a hydantoinyl group), an aromatic azo group (such as a phenylazo group), etc., and these groups may have the substituent(s) as referred to in the above-mentioned $R_{12}$, $R_{13}$ and $R_{14}$.

More preferable split-off groups among them are those which can be split off in the form of an anion; and typical examples thereof are a halogen atom, an alkoxy group, an aryloxy group, an arylthio group, a sulfonyloxy group, and an acylamino group.

Any one of these $R_{12}$, $R_{13}$, $R_{14}$ and $X_5$ is to be divalent group to be linked with $-Y)_{n1}$ of the formula (III) or (IV).

The compounds of the formulae (F-1) through (F-6) as well as the methods for the synthesis of these compounds are described in the following publications.

The compounds of the formula (F-1) are described in U.S. Pat. No. 4,500,630, etc.; those of the formula (F-2) are in Japanese patent application (OPI) No. 43659/85, etc.; those of the formula (F-3) are in Japanese patent publication No. 27411/72, etc.; those of the formula (F-4) are in European Pat. No. 119,860A, etc.; those of the formula (F-5) are in Japanese patent application (OPI) No. 33552/85, etc.; and those of the formula (F-6) are in U.S. Pat. No. 3,061,432, etc., respectively.

The compounds of the formulae (F-1) through (F-6) may have highly color-forming ballast groups as described in Japanese patent application (OPI) No. 52045/83, European Pat. No. 126,433A, U.S. Pat. Nos. 4,513,082 and 4,503,141, and Japanese patent application (OPI) No. 177557/84.

Specific examples of the two-equivalent pyrazoloazole type couplers which can be used in the present invention are given hereunder, which are, however, not whatsoever limitative.

MC-23

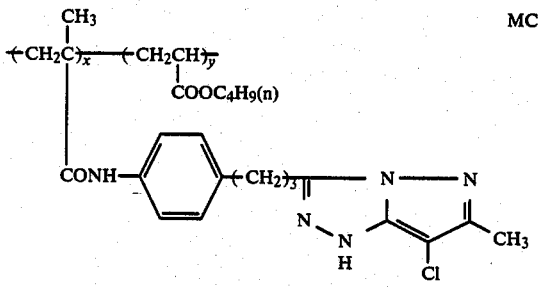

x/y = 52/48 (wt)

MC-24

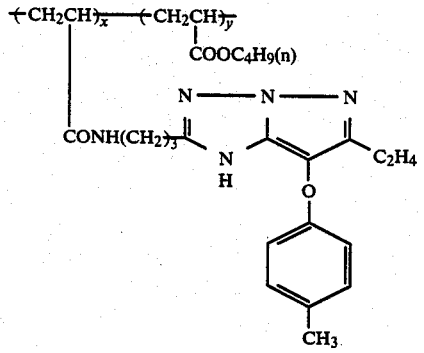

x/y = 48/52 (wt)

MC-25

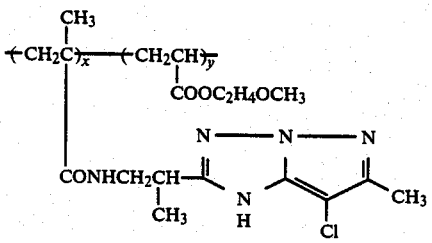

x/y = 49/51 (wt)

-continued

MC-26

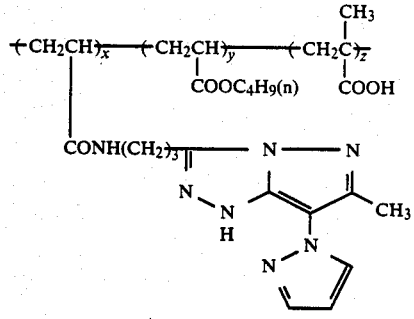

x/y/z = 36/58/6 (wt)

MC-27

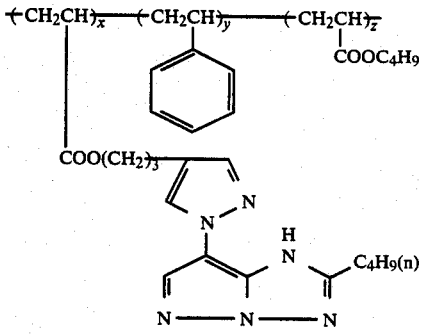

x/y/z = 44/19/37 (wt)

MC-28

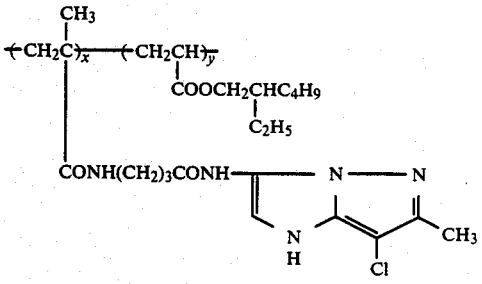

x/y = 36/64 (wt)

MC-29

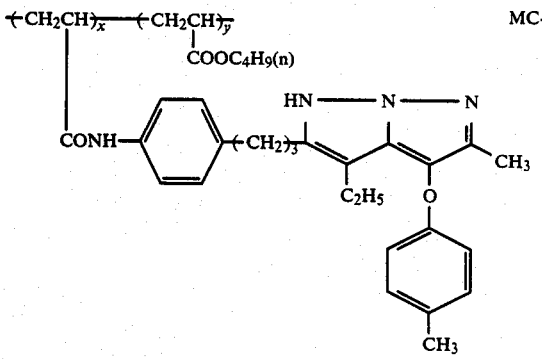

x/y = 46/54 (wt)

-continued

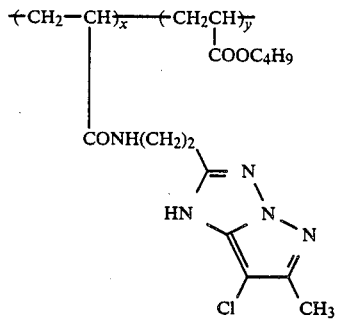

MC-30 x/y = 50/50 (wt)

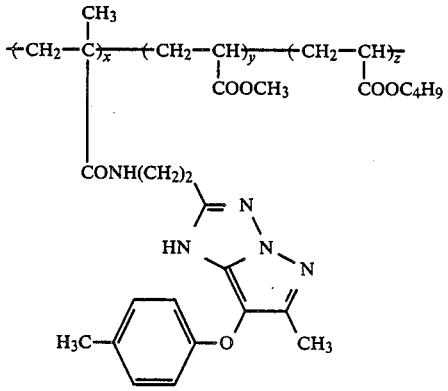

MC-31 x/y/z = 50/25/25 (wt)

The sensitizing dyes represented by the formulae (I) and (II) which are used in the present invention are known compounds, and these can easily be synthesized in accordance with the methods as described, for example, in Japanese patent publication No. 7828/63, *Research Disclosure,* No. 15818 (1977), *Heterocyclic Compounds—Cyanine Dyes and Related Compounds,* Chap. 5, ppl 116–147 (written by F. A. Hamer and published by John Wiley and Sons Co., in 1964) and *Heterocyclic Compounds—Special Topics in Heterocyclic Chemistry,* Chap. 8, Item 4, pp. 482–515 (written by D. M. Strumer and published by John Wiley and Sons Co., in 1977).

The sensitizing dye of the present invention is incorporated in the silver halide photographic emulsion in an amount of $1\times10^{-6}$ mole to $5\times10^{-3}$ mole, preferably $1\times10^{-5}$ mole to $2.5\times10^{-3}$ mole, especially preferably $4\times10^{-5}$ mole to $1\times10^{-3}$ mole, per mole of the silver halide.

Th sensitizing dye of the present invention can directly be dispersed in the emulsion. Otherwise, the dye is first dissolved in a pertinent solvent such as methyl alcohol, ethyl alcohol, methyl cellosolve, acetone, water, pyridine or a mixture thereof and, then, the solution is added to the emulsion. Ultrasonic waves may be used for the dissolution. For the addition of the sensitizing dye to the emulsion, various means may be utilized including, for example, a method where the dye is dissolved in a volatile organic solvent and the solution is dispersed in a hydrophilic colloid, followed by adding the dispersion to the emulsion, as described, for example, in U.S. Pat. No. 3,469,987; a method where the water-insoluble dye is dispersed in a water-soluble solvent without dissolution, followed by adding the dispersion to the emulsion, as described, for example, in Japanese patent publication No. 24185/71; a method where the dye is dissolved in a surfactant, followed by adding the solution to the emulsion, as described, for example, in U.S. Pat. No. 3,822,135; a method where the dye is dissolved by the use of a red-shifting compound, followed by adding the solution to the emulsion, as described, for example, in Japanese patent application (OPI) No. 74624/76; a method where the dye is dissolved in an acid which does not substantially contain water, followed by adding the solution to the emulsion, as described, for example, in Japanese patent application (OPI) No. 80826.75, etc. Besides, methods as described, for example, in U.S. Pat. Nos. 2,912,343, 3,342,605, 2,996,287 and 3,427,835 can be applied to the addition of the sensitizing dye to the emulsion. While the sensitizing dye can uniformly be dispersed in the silver halide emulsion before being coated on a pertinent support, it can, of course, be dispersed at any stage of the preparation of the silver halide emulsion.

The sensitizing dye of the present invention may be used in combination with other sensitizer dye. For instance, sensitizing dyes as described, for example, in U.S. Pat. Nos. 3,703,377, 2,688,545, 3,397,060, 3,615,635 and 3,628,964, British Pat. Nos. 1,242,588 and 1,293,862, Japanese patent publication Nos. 4936/68, 14030/69 and 10773/68, U.S. Pat. No. 3,416,926, Japanese patent publication No. 4930/68, U.S. Pat. Nos. 3,615,613, 3,615,632, 3,617,295 and 3,635,721 may be used therefor.

When the two-equivalent magenta polymer coupler of the present invention is used, it is surprising that the amount of the sensitizing dye added for attainment of the maximum density is $\frac{3}{4}$ to $\frac{1}{2}$ of the amount of the conventional four-equivalent magenta coupler.

The reason for this is not clear, but it is assumed that the amount of the sensitizing dye adsorbed may be large.

Among the two-equivalent magneta polymer couplers of the present invention, those having a 5-pyrazolone nucleus are preferred and, in particular, those further having an azole group as a split-off group are especially preferred. The most preferred coupler is the above-mentioned Coupler MC-5.

The compounds of the formulae (III) and (IV) of the present invention can be used singly or in the form of a combination of two or more of them.

The amount of the two-equivalent magenta polymer coupler used in the present invention is 30 mole% or more, preferably 50 to 100 mole%, of the total amount of the magenta couplers in the photographic material.

The two-equivalent magenta polymer coupler used in the present invention is added in an amount of from 0.005 to 0.5 mole and preferably from 0.01 to 0.05 mole per mole of the silver halide, based on the coupler monomer thereof.

In the method of the present invention, the washing step and/or the stabilization step is generally carried out in succession after the fixing step or the bleach-fixing step has been carried out.

Various known compounds may be added to the washing bath and/or the stabilization bath for the purpose of the prevention of precipitation or of the stabilization of the washing water. For instance, additives including chelating agents such as inorganic phosphoric acids, aminopolycarboxylic acids and organic aminopolyphosphonic acids, sterilizers or antimolds for preventing the generation of various bacteria, algae or fungi (for example, compounds as described in *J. Antibacterial and Antifungal Agents,* Vol. 11, No. 5, pp. 207–223 (1983), metal salts such as magnesium salts, aluminum salts or bismuth salts, alkali metal or ammonium salts, surfactants for preventing the drying load or unevenness, or various kinds of hardeners may be added, if necessary. Further, compounds as described in West, *Photographic Science and Engineering*, Vol. 6, pp. 344–359 (1965) may also be used. In particular, chelating agents as well as sterilizers or antimolds are effective.

In the washing, a multistage countercurrent washing system by the use of two or more water tanks can be employed for the purpose of economization of the amount of water. A multistage countercurrent stabilization treatment as described in Japanese patent application (OPI) No. 8543/82 may be carried out in place of the washing treatment. Various compounds are added in the stabilization bath for the purpose of stabilizing the formed images. For instance, typical additives are various kinds of buffers to regulate the pH of the film (to, for example, the range of pH 3 to 8) (such as combinations of borates, metaborates, borax, phosphates, carbonates, potassium hydroxide, sodium hydroxide, aqueous ammonia, monocarboxylic acids, dicarboxylic acids, or polycarboxylic acids) as well as aldehydes such as formalin. In addition, other additives may also be used, if desired, including chelating agents (such as inorganic phosphoric acids, aminopolycarboxylic acids, organic phosphonic acids, aminopolyphosphonic acids, phosphonocarboxylic acids, etc.), sterilizers (such as thiazole-type compounds, isothiazole-type compounds, halogenated phenols, sulfanilamides, benzotriazoles, etc.), surfactants, fluorescent whiteners, and hardeners. Two or more kinds of the same or different additives may be used together.

In the present invention, addition of an ammonium salt, such as ammonium chloride, ammonium nitrate, ammonium sulfate, ammonium phosphate, ammonium sulfite, or ammonium thiosulfate, as a pH controller for the film after processing is preferred so as to improve the image stability.

In the photographing color photographic materials, the "washing-stabilization" step which is generally carried out after the fixing may be replaced by the above-mentioned stabilization step and the washing step (treatment for economization of water). The formalin in the stabilization bath can be omitted.

The time required for the washing and the stabilization in the present invention varies depending upon the kind of photographic materials to be processed and the processing conditions but generally ranges from 20 seconds to 10 minutes and preferably from 20 seconds to 5 minutes.

The layer constitution of each color-sensitive layer of the photographic material of the present invention may comprise two layers of a high-speed layer and a low-speed layer or three layers having an interlayer between a high-speed and a low-speed layer. Further, a non-light-sensitive layer may be placed between the high-speed layer and the low-speed layer.

The photographic emulsion layer of the photographic light-sensitive material of the present invention may have any silver halide of silver bromide, silver iodobromide, silver iodochlorobromide, silver chlorobromide, and silver chloride. Preferred silver halides are silver iodobromide or silver iodochlorobromide containing about 30 mole% or less of silver iodide. In particular, silver iodobromide containing about 2 mole% to 25 mole% of silver iodide is especially preferred.

The silver halide grains in the photographic emulsion may be so-called regular grains having a cubic, octahedral, tetradecahedral or the like regular crystalline form, or irregular grains having a spherical or the like irregular crystalline form, or otherwise, may be those having twin plane or the like crystal defects or composite grains comprising a combination of these crystalline forms.

Regarding the grain size of the silver halide grains, there may be used fine grains having a grain size of about 0.1μ or less or large grains having a projected area diameter of up to about 10μ, and the silver halide emulsion may be a monodispersed emulsion having a narrow grain size distribution or a polydispersed emulsion having a broad grain size distribution.

The silver halide photographic emulsions usable in the present invention can be prepared in a conventional manner, for example, in accordance with the methods as described in *Research Disclosure*, RD No. 17643 (December, 1978), pp. 22–23, "I. Emulsion Preparation and Types" and ibid., RD No. 18716 (November, 1979), page 648.

Further, the photographic emulsions usable in the present invention can also be prepared in accordance with the methods as described in *Chimie Physique Photographique* (written by P. Glafkides and published by Paul Montel in 1967), *Photographic Emulsion Chemistry* (written by G. F. Duffin and published by Focal Press in 1966), and *Making and Coating Photographic Emulsion* (written by V. L. Zelikman et al. and published by Focal Press in 1964). For instance, any of an acid method, a neutral method or an ammonia method may be adapted to the formation of the emulsions; and to the reaction of a soluble silver salt and a soluble halogen salt, a one-side mixing methods, a simultaneous mixing method, or a combination thereof may be adapted. In addition, a method for the formation of silver halide grains in the presence of an excess silver ion (which is a so-called reverse mixing method) may also be utilized. A so-called controlled double-jet method where the pAg value in the liquid phase for the formation of silver halides is kept constant may also be used, which is one embodiment of the simultaneous mixing method. According to this method, an emulsion of silver halide grains having a regular crystalline form and a nearly uniform grain size distribution can be obtained.

For the preparation of the silver halide photographic emulsions used in the present invention, two or more of silver halide emulsions which are separately formed may be blended.

The silver halide emulsion comprising the above-mentioned regular grains can be obtained by controlling the pAg value and the pH value in the formation of the grains. Details of this procedure are described, for example, in *Photographic Science and Engineering*, Vol. 6, pp. 159–165 (1962), *Journal of Photographic Science*, Vol. 12, pp. 242–251 (1964), U.S. Pat. No. 3,655,394, and British Pat. No. 1,413,748.

One typical monodispersed emulsion is an emulsion comprising silver halide grains with an average grain diameter of more than about 0.1μ, in which at least about 95% by weight of the grains fall within ±40% of the average grain diameter. In the present invention, such emulsions can be used as those where the silver halide grains therein have an average grain diameter of about 0.25 to 2μ and at least 95% by weight of the grains or at least 95% of the number of the grains fall within ±20% of the average grain diameter. The method for the preparation of these emulsions is described, for example, in U.S. Pat. Nos. 3,574,628 and 3,655,394 and British Pat. No. 1,413,748. Further, the monodispersed emulsions as described in Japanese patent application (OPI) Nos. 8600/73, 39027/76, 83097/76, 137133/78, 48521/79, 99419/79, 37635/83, and 49938/83 can also preferably be used in the present invention.

In addition, tabular grains having an aspect ratio of about 5 or more can also be used in the present invention. The tabular grains can easily be prepared in accordance with methods described, for example, in Gutoff, *Photographic Science and Engineering,* Vol. 14, pp. 248–257 (1970), U.S. Pat. Nos. 4,434,226, 4,414,310, 4,433,048, and 4,439,520, and British Pat. No. 2,112,157. The use of the tabular grains is advantageous with respect to improvement of the color sensitization efficiency by sensitizing dyes, improvement of graininess and elevation of sharpness, which is described in detail, for example, in the above-mentioned U.S. Pat. No. 4,434,226.

The crystal structure of the silver halide grain used in the present invention may be uniform or may have a halogen composition different between the inner and outer portions thereof or be stratiform. These emulsion grains are illustrated, for example, in British Pat. No. 1,027,146, U.S. Pat. Nos. 3,505,068 and 4,444,877, and Japanese patent application (OPI) No. 143331/85. In addition, the silver halide grains may comprise epitaxial crystals containing different silver halide compositions or containing silver rhodanide or lead oxide rather than silver halides. These emulsion grains are illustrated, for example, in U.S. Pat. Nos. 4,094,684, 4,142,900, and 4,459,353, British Pat. No. 2,038,792, U.S. Pat. Nos. 4,349,622, 4,395,478, 4,433,501, 4,463,087, 3,656,962, and 3,852,067, and Japanese patent application (OPI) No. 162540/84.

Further, mixtures comprising silver halide grains of different crystalline forms may also be used.

The emulsion used in the present invention are, in general, those that are subjected to physical ripening, chemical ripening and spectral sensitization. Additives used in these steps are described in *Research Disclosure,* No. 17643 and ibid., No. 18716, and the relevant parts therein are listed in the following Table.

Known photographic additives which can be used in the present invention are also described in the two *Research Disclosure* references, and the relevant parts therein are also listed in the following Table.

| Kind of Additives | RD17643 | RD18716 |
|---|---|---|
| 1. Chemical Sensitizers | p. 23 | p. 648, right column |
| 2. Sensitivity Increasing Agents | | p. 648, right column |
| 3. Spectral Sensitizers and Supersensitizers | pp. 23–24 | p. 648, right column to p. 649, right column |
| 4. Whitening Agents | p. 24 | |
| 5. Antifoggants and Stabilizers | pp. 24–25 | p. 649, right column |
| 6. Light-Absorbers, Filter Dyes, and Ultraviolet Light Absorbents | pp. 25–26 | p. 649, right column to p. 650, left column |
| 7. Antistaining Agents | p. 25, right column | p. 650, left column to right column |
| 8. Dye Image Stabilizers | p. 25 | |
| 9. Hardeners | p. 26 | p. 651, left column |
| 10. Binders | p. 26 | p. 651, left column |
| 11. Plasticizers and Lubricants | p. 27 | p. 650, right column |
| 12. Coating Aids and Surfactants | pp. 26–27 | p. 650, right column |
| 13. Antistatic Agents | p. 27 | p. 650, right column |

Various color couplers may be used in the present invention, and specific examples thereof are described in the patent specifications referred to in the aforesaid *Research Disclosure,* No. 17643, VII-C through G. Important dye-forming couplers are those capable of forming three primary colors (of yellow, magenta, and cyan) in a subtractive color process by color development, and specific examples of non-diffusible four-equivalent or two-equivalent couplers which may be used in the present invention are described in the patent specifications referred to in *Research Disclosure,* No. 17643, VII-C and D. In addition, other couplers as mentioned below may also preferably be used in the present invention.

Typical examples of yellow couplers which may be used in the present invention are hydrophobic acylacetamide type couplers having a ballast group. Specific examples thereof are described, for example, in U.S. Pat. Nos. 2,407,210, 2,875,057, and 3,265,506. Two-equivalent yellow couplers are particularly preferably used in the present invention; and typical examples thereof are oxygen atom-releasing type yellow couplers as described in U.S. Pat. Nos. 3,408,194, 3,447,928, 3,933,501, and 4,022,620; and nitrogen atom-releasing type yellow couplers as described in Japanese patent publication No. 10739/83, U.S. Pat. Nos. 4,401,752 and 4,326,024, *Research Disclosure,* No. 18053 (April, 1979), British Pat. No. 1,425,020, and German patent application (OLS) Nos. 2,219,917, 2,261,361, 2,329,587, and 2,433,812. α-Pivaloylacetanilide type couplers are good in fastness, especially to light, of the formed dyes; and, on the other hand, α-benzoylacetanilide type couplers are high in color density of the formed dyes.

Magenta couplers which may be used in combination in the present invention are ballast group-containing hydrophobic indazolone type or cyanoacetyl type couplers, preferably 5-pyrazolone type or pyrazoloazole type couplers. Among the 5-pyrazolone type couplers, those whose 3-position is substituted by an arylamino group or an acylamino group are preferred because of hue and color density of the formed dyes. Typical examples of these couplers are described in U.S. Pat. Nos. 2,311,082, 2,343,703, 2,600,788, 2,908,573, 3,062,653, 3,152,896, and 3,936,015. Regarding the split-off group of the two-equivalent 5-pyrazolone type couplers, nitrogen atom-releasing groups as described in U.S. Pat. No. 4,310,619 and arylthio groups as described in U.S. Pat. No. 4,351,897 are especially preferred. In addition, ballast group-containing 5-pyrazolone type couplers as described in European Pat. No. 73,636 are preferred because they provide a high color density. Pyrazoloazole type couplers which may be used in the present invention include pyrazolobenzimidazoles as described in U.S. Pat. No. 3,061,432, preferably pyrazolo[5,1-c][1,2,4]triazoles as described in U.S. Pat. No. 3,725,067; pyrazolotetrazoles as described in *Research Disclosure,* No. 24220 (June, 1984) and Japanese patent application (OPI) No. 33552/85; and pyrazolopyrazoles as described in *Research Disclosure,* No. 24230 (June, 1984) and Japanese patent application (OPI) No. 43659/85. In particular, imidazo[1,2-b]pyrazoles as described in U.S. Pat. No. 4,500,630 are preferred because the yellow side-absorption of the formed dyes is small and the light-fastness thereof is high and, especially, pyrazolo[1,5-b][1,2,4]triazole as described in U.S. Pat. No. 4,540,654 is particularly preferred.

As cyan couplers which can be used in the present invention, hydrophobic and diffusion-resistant naphthol type and phenol type couplers are exemplified. Typical examples thereof include naphthol type couplers as described in U.S. Pat. No. 2,474,293 and preferably oxygen atom-releasing type two-equivalent naphthol type couplers as described in U.S. Pat. Nos. 4,052,212, 4,146,396, 4,228,233 and 4,296,200, etc. Specific examples of phenol type couplers are described in U.S. Pat. Nos. 2,369,929, 2,801,171, 2,772,162 and 2,895,826, etc.

Cyan couplers capable of forming cyan dyes fast to humidity and temperature are preferably used in the present invention. Typical examples thereof include phenol type cyan couplers having an alkyl group more than a methyl group at the meta-position of the phenol nucleus as described in U.S. Pat. No. 3,772,002, 2,5-diacylamino-substituted phenol type couplers as described in U.S. Pat. Nos. 2,772,162, 3,758,308, 4,126,396, 4,334,011 and 4,327,173, West German patent application (OLS) No. 3,329,729, and European Pat. No. 121,365, etc., phenol type couplers having a phenylureido group at the 2-position thereof and an acylamino group at the 5-position thereof as described in U.S. Pat. Nos. 3,446,622, 4,333,999, 4,451,559 and 4,427,767, etc. Further, cyan couplers of the naphtnol type having a sulfonamido group or an amido group, etc. at the 5-position thereof as described in Japanese patent application (OPI) Nos. 237448/85, 153640/86 and 145557/86 are also preferably employed in the present invention because of excellent fastness of color images formed therefrom.

In the present invention, it is preferred to use colored couplers for masking together in color photographic light-sensitive materials for photographing in order to correct undesirable absorption of dyes formed. Typical examples are yellow-colored magenta couplers as described in U.S. Pat. No. 4,163,670 and Japanese patent publication No. 39413/82 and magenta-colored cyan couplers as described in U.S. Pat. Nos. 4,004,929 and 4,138,258 and British Pat. No. 1,146,368. Further, colored couplers as described in *Research Disclosure,* No. 17643 (December, 1978), "VII-G" are also useful.

Further, couplers capable of forming appropriately diffusible dyes can be used together in order to improve graininess. Specific examples of such types of magenta couplers are described in U.S. Pat. No. 4,366,237 and British Pat. No. 2,125,570, etc. and those of yellow, magenta and cyan couplers are described in European Pat. No. 96,570 and West German Patent Application (OLS) No. 3,234,533, etc.

Dye forming couplers and the above described special couplers may form polymers including dimers or more. Typical examples of polymerized dye forming couplers are described in U.S. Pat. Nos. 3,451,820 and 4,080,211, etc. Specific examples of polymerized magenta couplers are described in British Pat. No. 2,102,173 and U.S. Pat. No. 4,367,282, etc.

Couplers capable of releasing a photographically useful residue during the course of coupling can also be employed preferably in the present invention. Specific examples of useful DIR couplers capable of releasing a development inhibitor are described in the patents cited in *Research Disclosure,* No. 17643 (December, 1978), "VII-F" as mentioned above.

DIR couplers which may preferably be used in the present invention are developer-deactivating type couplers as typically described in Japanese Patent Application (OPI) No. 151944/82; timing type couplers as typically described in U.S. Pat. No. 4,248,962 and Japanese Patent Application (OPI) No. 154234/82; and reactive type couplers as typically described in Japanese Patent Application (OPI) No. 184248/85. In particular, especially preferred couplers are developer-deactivating type DIR couplers as described in Japanese Patent Application (OPI) Nos. 151944/82, 217932/83, 211844/85, 225156/85, and 233650/85; and reactive type DIR couplers as described in Japanese Patent Application (OPI) No. 184248/85.

The photographic materials of the present invention may contain such couplers that can imagewise release a nucleating agent or a development accelerator, or precursors thereof during the development. Examples of these compounds are described in British Pat. Nos. 2,097,140 and 2,131,188. In particular, such couplers that can release a nucleating agent having an adsorbability to silver halides are especially preferred; and examples thereof are described, for example, in Japanese Patent Application (OPI) Nos. 157638/84 and 170840/84.

Supports which may suitable be used in the present invention are described, for example, in the aforesaid *Research Disclosure, No.* 17643, page 28 and ibid., No. 18716, from page 647, right-hand column to page 648, left-hand column.

The color photographic materials of the present invention may be developed by means of a conventional developing means as described, for example, in the aforesaid *Research Disclosure,* NO. 17643, pp. 28–29 and ibid., No. 18716, page 651, from left-hand column to right-hand column.

The color-forming developer used for the development of the photographic material of the present invention is preferably an alkaline aqueous solution containing as a main component an aromatic primary amine color developing agent. As the color developing agent there are aminophenol type compounds and, in particular, p-phenylenediamine type compounds are especially preferably used. Typical examples thereof are 3-methyl-4-amino-N,N-diethylaniline, 3-ethyl-4-amino-N-ethyl-N-β-hydroxyethylaniline, 3-methyl-4-amino-N-ethyl-N-β-methanesulfonamidoethylaniline, and 3-methyl-4-amino-N-ethyl-N-β-methoxyethylaniline, or sulfates, hydrochlorides, and phosphates thereof; and p-toluenesulfonates, tetraphenylborates, and p-(t-octyl)benzenesulfonates. These diamines are, in general, more stable and preferable in the salt form than in the free form.

Aminophenol type derivatives include, for example, o-aminophenol, p-aminophenol, 4-amino-2-methylphenol, 2-amino-3-methylphenol, 2-oxy-3-amino-1,4-dimethylbenzene, etc.

Further, the compounds as described in J. F. A. Mason, *Photographic Processing Chemistry* (by Focal Press, in 1966), pp. 226–229, U.S. Pat. Nos. 2,193,015 and 2,592,364, and Japanese Patent Application (OPI) No. 64933/73 may also be used. If desired, two or more of color developing agents may be combined and used in the present invention.

The color-forming developer may contain a pH buffer such as alkali metal carbonates, borates or phosphates; a development inhibitor or antifogging agent such as bromides, iodides, benzimidazoles, benzotiazoles, or mercapto compounds; a preservative such as hydroxylamines, triethanolamine, compounds as described in German Patent Application (OLS) No. 2,622,950, sulfites, or bisulfites; an organic solvent such as diethylene glycol; a development accelerator such as benzyl alcohol, polyethylene glycol, quaternary ammonium salts, amines, thiocyanates, or 3,6-thiaocane-1,8-diol; a dye-forming coupler; a competing coupler; a nucleating agent such as sodium boron hydride; an auxiliary developer such as 1-phenyl-3-pyrazolidone; a tackifier; a chelating agent such as ethylenediaminetetraacetic acid, nitrilotriacetic acid, cyclohexanediaminetetraacetic acid, iminodiacetic acid, N-hydroxymethylethylenediaminetetraacetic acid, diethylenetriaminepentaacetic acid, triethylenetetraminehexaacetic acid, and the like aminopolycarboxylic acids as described, for example, in Japanese Patent Application (OPI) No. 195845/83, 1-hydroxyethylidene-1,1'-diphosphonic acid, organic phosphonic acids as described in *Research Disclosure,* No. 18170 (May, 1979), aminotris(-methylenephosphonic acid), ethylenediamine-N,N,N',N'-tetramethylenephosphonic acid and other aminophosphonic acids, or phosphonocarboxyic acids as described in Japanese Patent Application (OPI) Nos. 102726/77, 42730/78, 121127/79, 4024/80, 4025/80, 126241/80, 65955/80, and 65956/80 and *Research Disclosure,* No. 18170 (May, 1979).

The color developing agent is generally used in a concentration of about 0.1 g to about 30 g, preferably about 1 g to about 15 g, per liter of the color-forming developer. The pH value of the color-forming developer is generally 7 or more, most generally about 9 to 13.

In the development of reversal color photographic materials, the material is, in general, first subjected to black-and-white development and then subjected to color-forming development. The black-and-white developer used contains a known black-and-white developing agent, such as hydroquinone, hydroquinone monosulfonate or the like dihydroxybenzenes, 1-phenyl-3-pyrazolidone or the like 3-pyrazolidones, or N-methyl-p-aminophenol or the like aminophenols, singly or in admixture.

The photographic emulsion layer after the color-forming development is usually subjected to a bleaching processing. The bleaching process may be performed simultaneously with (i.e, bleach-fixing processing) or separately from a fixing process. Furthermore, for quickening the photographic process, a process of bleach-fixing after bleaching may be employed.

As a bleaching agent for the bleaching process or bleach-fixing process, there are, for example, compounds of polyvalent metals such as iron(III), cobalt(III), chromium(VI), copper(II), etc. (e.g., ferricyanides); peracids; quinones; nitroso compounds; bichromates; organic complex salts of iron(III) (e.g., complex salts of aminopolycarboxylic acids such as ethylenediaminetetraacetic acid, diethylenetriaminepentaacetic acid, etc. or of organic phosphonic acids such as aminopolyphosphonic acid, phosphonocarboxylic acid, organic phosphonic acids, etc.); organic acids such as citric acid, tartaric acid, malic acid, etc; persulfates; hydrogen peroxide, etc. In these materials, organic complex salts of iron(III) are preferred from the viewpoint of quick processing and prevention of environmental pollution.

Examples of the aminopolycarboxylic acids, aminopolyphosphonic acids, and organic phosphonic acids or the salts thereof are as follows:

Ethylenediaminetetraacetic acid
Diethylenetriaminepentaacetic acid
Ethylenediamine-N-(β-oxyethyl)-N,N',N'-triacetic acid
1,2-Diaminopropanetetraacetic acid
Triethylenetetraminehexaacetic acid
Propylenediaminetetraacetic acid
Nitrilotriacetic acid
Nitrilotripropionic acid
Cyclohexanediaminetetraacetic acid P0 1,3-Diamino-2-propanoltetraacetic acid
Methyliminodiacetic acid
Iminodiacetic acid
Hydroxyliminodiacetic acid
Dihydroxyethylglycine ethyl ether diaminetetraacetic acid
Glycol ether diaminetetraacetic acid
Ethylenediaminetetrapropionic acid
Ethylenediaminedipropionic acid
Phenylenediaminetetraacetic acid
2-Phosphonobutane-1,2,4-triacetic acid
1,3-Diaminopropanol-N,N,N',N'-tetramethylenephosphonic acid
1,3-Propylenediamine-N,N,N',N'-tetramethylenephosphonic acid
1-Hydroxyethylidene-1,1'-diphosphonic acid.

In the aforesaid compounds, the iron(III) complex salts of ethylenediaminetetraacetic acid, diethylenetriaminepentaacetic acid, cyclohexanediaminetetraacetic acid, 1,3-diaminopropanetetraacetic acid, or methyliminodiacetic acid are preferred because of their high bleaching power.

As the iron(III) complex salt(s), one or more complex salts already formed on ferric ion complex salt(s) formed by reacting iron(III) salt(s) (e.g., ferric sulfate, ferric chloride, ferric nitrate, ferric ammonium sulfate, ferric phosphate, etc.) and a chelating agent (e.g., aminopolycarboxylic acid, aminopolyphosphonic acid, phosphonocarboxylic acid, etc.) in a solution may be used. In the case of forming the complex salt in a solution, two or more kinds of ferric salts or chelating agents may be used. In both of the complex salt already formed and the complex salt formed in a solution, a stoichiometric amount or more of a chelating agent may be used.

Also, the bleaching solution or bleach-fixing solution containing the above-described ferric ion complex salt(s) may further contain ions of metals other than iron, such as calcium, magnesium, aluminum, nickel, bismuth, zinc, tungsten, cobalt, copper, etc. or complex salts thereof, or hydrogen peroxide.

The persulfate for use in the bleaching or bleach-fixing processing of the present invention includes an alkali metal persulfate such as potassium persulfate, sodium persulfate, etc., or ammonium persulfate.

Furthermore, the bleaching solution or bleach-fixing solution may contain a rehalogenating agent such as a bromide (e.g., potassium bromide, sodium bromide, ammonium bromide, etc.), a chloride (e.g., potassium chloride, sodium chloride, ammonium chloride, etc.), or an iodide (e.g., ammonium iodide, etc.). Also, if desired, the bleaching solution or bleach-fixing solution may further contain a corrosion inhibitor, etc., for example, inorganic acids or organic acids having a pH buffer faculty, or alkali metal salts or ammonium salts thereof, such as boric acid, borax, sodium metaborate, acetic acid, sodium acetate, sodium carbonate, potassium carbonate, phosphorus acid, phosphoric acid, sodium phosphate, citric acid, sodium citrate, tartaric acid, or ammonium nitrate, guanidine, etc.

A proper amount of the bleaching agent is from 0.1 to 2 mols per liter of the bleaching solution and a preferred pH range of the bleaching solution is from 0.5 to 8.0 in the case of ferric ion complex salts, in particular from 4.0 to 7.0 in the case of ferric ion complex salts of aminopolycarboxylic acid, aminopolyphosphonic acid, phosphonocarboxylic acid, or organic phosphonic acid. In the case of using a persulfate, the concentration thereof is 0.1 to 2 mols/liter and the pH range is from 1 to 5.

As a fixing agent for the fixing solution or the bleach-fixing solution which is used in this invention, known fixing agents can be used. That is, water-soluble silver halide solvents, e.g., thiosulfates such as sodium thiosulfate, ammonium thiosulfate etc.; thiocyanates such as sodium thiocyanate, ammonium thiocyanate, etc.; thioether compounds such as ethylenebisthioglycolic acid, 3,6-dithia-1,8-octanediol, etc.; thioureas, etc., can be used as the fixing agent. They may be used solely or as a mixture thereof. Furthermore, for bleach-fixing processing, a specific bleach-fixing solution containing a combination of a fixing agent and a large amount of a halogen compound such as potassium iodide described in Japanese Patent Application (OPI) No. 155354/80 can be used.

In the case of the fixing or bleach-fixing processing, the concentration of the fixing agent is preferably from 0.2 to 4 mols/liter. Also, in the bleach-fixing processing it is preferred that the concentration of the ferric ion complex salt is from 0.1 to 2 mols and that of the fixing agent is from 0.2 to 4 mols per liter of the bleach-fixing solution. Furthermore, the pH of the fixing solution or bleach-fixing solution is usually from 4.0 to 9.0, preferably from 5.0 to 8.0.

The fixing solution or bleach-fixing solution may further contain a preservative such as sulfites (e.g., sodium sulfite, potassium sulfite, ammonium sulfite, etc.), hydrogensulfites, hydroxylamine, hydrazine, hydrogensulfite addition products of aldehyde compounds (e.g., acetaldehydesodium hydrogensulfite addition product), etc. in addition to the above-described additives. Furthermore, the fixing solution or bleach-fixing solution may further contain a fluorescent whitening agent, a defoaming agent, a surface active agent, and an organic solvent such as polyvinylpyrrolidone, methanol, etc.

For the bleaching solution, bleach-fixing solution, or the preceding bath thereof, a bleaching accelerator may be, if desired, used. Specific examples of useful bleaching accelerators are compounds having a mercapto group or a disulfido group described in U.S. Pat. No. 3,893,858, West German Pat. Nos. 1,290,812 and 2,059,988, Japanese Patent Application (OPI) Nos. 32736/78, 57831/78, 37481/78, 65732/78, 72623/78, 95630/78, 95631/78, 104232/78, 124424/78, 141623/78, and 28426/78, *Research Disclosure,* RD No. 17129 (July 1978), etc.; thiazolidine derivatives described in Japanese Patent Application (OPI) No. 140129/75; thioureas described in Japanese Patent Publication No. 8506/70, Japanese Patent Application (OPI) Nos. 20832/77 and 32735/78, and U.S. Pat. No. 3,706,561; iodides described in West German Pat. No. 1,127,715, and Japanese Patent Applicatin (OPI) No. 16235/83;polyethylene oxides described in West German Pat. Nos. 860,410 and 2,748,430; polyamine compounds described in Japanese Patent Publication No. 8836/70; and compounds described in Japanese Patent Application (OPI) Nos. 42434/74, 59644/74, 94927/78, 35727/79, 26506/80, and 163940/83, as well as iodide ions and bromide ions. In these compounds, the compounds having a mercapto group or a disulfido group are preferred from the viewpoint of high acceleration effect. The compounds described in U.S. Pat. No. 3,893,858, West German Pat. No. 1,290,812, and Japanese Patent Application (OPI) No. 95630/78 are particularly preferred.

These bleaching accelerators may be added to the photographic light-sensitive material.

In the present invention, each processing solution is used at 10° C. to 50° C. In general, the standard processing temperature is 33° C. to 38° C. If desired, the temperature may be elevated more so as to accelerate the processing and reduce the processing time or, on the contrary, the temperature may be lowered so as to improve the image quality and improve the stability of the processing solution. In order to economize the amount of the silver used in the photographic material, a cobalt-intensifier or a hydrogen peroxide-intensifier as described in German Pat. No. 2,226,770 and U.S. Pat. No. 3,674,499 may be used, or the material may be processed in a combined developing-bleach-fixing bath as described in U.S. Pat. No. 3,923,511.

The processing time may be made shorter to the range with no obstruction than the standard time, if desired, so as to accelerate the processing of the material.

The silver halide color photographic material of the present invention may be incorporated with a color developing agent or a precursor thereof so as to simplify and accelerate the processing of the material. For the incorporation, the precursor is more preferred than the agent because the stability of the photographic material may be kept high. Specific examples of the developing agent precursor are indaniline type compounds as described in U.S. Pat. No. 3,342,597; Shiff base type compounds as described in U.S. Pat. No. 3,342,599 and *Research Disclosure,* No. 14580 (August, 1976) and ibid., No. 15159 (November, 1976); aldol compounds as described in *Research Disclosure,* No. 13924; metal complexes as described in U.S. Pat. No. 3,719,492; urethane type compounds as described in Japanese Patent Application (OPI) No. 135628/78, etc. In addition, various salt type precursors as described in Japanese Patent Application (OPI) Nos. 6235/81, 16133/81, 59232/81, 67842/81, 83734/81, 83735/81, 83736/81, 81837/81, 54430/81, 106241/81, 107236/82, and 83565/82 may also be used in the present invention.

The silver halide color photographic material of the present invention may be incorporated with a variety of 1-phenyl-3-pyrazolidones so as to accelerate the color development thereof. Typical examples of the compounds are described in Japanese Patent Application (OPI) Nos. 64339/81, 144547/82, 211147/82, 50532/83, 50536/83, 50533/83, 50534/83, 50535/83, and 115438/83.

In the continuous processing of the photographic material, a replenisher of each processing solution is fed into each bath so as to prevent the variation of the liquid composition of each bath, whereby uniform finishing can be achieved. The amount of the replenisher fed in each bath may be reduced to a half of the standard amount of the replenisher or less.

Each processing bath may be provided with a heater, a temperature sensor, a liquid level sensor, a circulating pump, a filter, a variety of floating lids, a variety of squeezers, etc., if desired.

In the case that the photogrphic light-sensitive material of the present invention is color paper, the material is generally subjected to bleach-fixing treatment; and if the material is a photographing color photographic material, the material may be subjected to bleach-fixing treatment, if desired.

Now, the present invention will be explained in greater detail by reference to the following examples which, however, are not intended to be interpreted as limiting the scope of the present invention.

Unless otherwise specified, all percents, ratios, etc. are by weight.

EXAMPLE 1

Layers each having the composition as shown below were coated on a subbed cellulose triacetate film support to obtain a multilayer color photographic material (Sample No. 101). Sample Nos. 102 to 111 were prepared in the same manner as the preparation of Sample No. 101, with the exception that 0.6 g/m$^2$ (0.96 mmole/m$^2$) of Coupler C-8 in the sixth layer (first green-sensitive emulsion layer) of Sample No. 101 was substituted by the same molar amount of each of the couplers as shown in Table 2 and that the sensitizing dye of the sixth layer of Sample No. 101 was substituted by each of the sensitizing dyes as shown in Table 2. Regarding the samples as prepared by using a two-equivalent magenta polymer coupler, the amount of the coupler used was 0.5 time the amount of the other couplers, because the two-equivalent coupler showed the maximum density when used in an amount of 0.5 time the amount of the other couplers.

The sensitizing dye used was first dissolved in methanol and then added to the emulsion at 40° C.

Constitution of Light-Sensitive Layer

Sample No. 101 was prepared as follows:

Regarding the amount of each component as coated, the silver halide and the colloidal silver were represented by the amount of the silver therein, the unit being g/m$^2$; the coupler, the additives and the gelatin were represented by the amount thereof, the unit being g/m$^2$; and the sensitizing dye was represented by the molar number of the dye as used per mole of the silver halide in the same layer.

First Layer (Anti-halation layer):

| | |
|---|---|
| Black colloidal silver | 0.2 |
| Gelatin | 1.3 |
| Ultraviolet light absorbent, UV-1 | 0.1 |
| Ultraviolet light absorbent, UV-2 | 0.2 |
| Dispersion oil, Oil-1 | 0.01 |
| Dispersion oil, Oil-2 | 0.01 |

Second Layer (Interlayer):

| | |
|---|---|
| Fine silver bromide grains (average grain size: 0.07 μm) | 0.15 |

-continued

| | |
|---|---|
| Gelatin | 1.0 |
| Colored Coupler C-1 | 0.1 |
| Colored Coupler C-2 | 0.01 |
| Dispersion oil, Oil-1 | 0.1 |

Third Layer (First red-sensitive emulsion layer):

| | |
|---|---|
| Silver iodobromide emulsion (silver iodide: 3 mol %, average grain size: 0.3 μm) | 1.6 |
| Gelatin | 1.6 |
| Sensitizing Dye I | $4.5 \times 10^{-4}$ |
| Sensitizing Dye II | $1.5 \times 10^{-4}$ |
| Coupler C-3 | 0.30 |
| Coupler C-4 | 0.40 |
| Coupler C-5 | 0.02 |
| Coupler C-2 | 0.003 |
| Dispersion oil, Oil-1 | 0.03 |
| Dispersion oil, Oil-3 | 0.012 |

Fourth Layer (Second red-sensitive emulsion layer):

| | |
|---|---|
| Silver iodobromide emulsion (silver iodide: 6 mol %, average grain size: 0.7 μm) | 1.0 |
| Gelatin | 1.0 |
| Sensitizing Dye I | $3 \times 10^{-4}$ |
| Sensitizing Dye II | $1 \times 10^{-4}$ |
| Coupler C-6 | 0.05 |
| Coupler C-7 | 0.015 |
| Coupler C-2 | 0.01 |
| Dispersion oil, Oil-1 | 0.01 |
| Dispersion oil, Oil-3 | 0.05 |

Fifth Layer (Interlayer):

| | |
|---|---|
| Gelatin | 1.0 |
| Compound, Cpd-A | 0.10 |
| Dispersion oil, Oil-1 | 0.05 |

Sixth Layer (First green-sensitive emulsion layer):

| | |
|---|---|
| Silver iodobromide emulsion (silver iodide: 4 mol %, average grain size: 0.3 μm) | 0.8 |
| Sensitizing Dye III | $9 \times 10^{-4}$ |
| Gelatin | 1.0 |
| Coupler C-8 | 0.60 |
| Coupler C-5 | 0.06 |
| Coupler C-1 | 0.15 |
| Dispersion oil, Oil-1 | 0.5 |

Seventh Layer (Second green-sensitive emulsion layer):

| | |
|---|---|
| Silver iodobromide emulsion (silver iodide: 6 mol %, average grain size: 0.7 μm) | 0.85 |
| Gelatin | 1.0 |
| Sensitizing Dye III | $3.5 \times 10^{-4}$ |
| Sensitizing Dye IV | $1.4 \times 10^{-4}$ |
| Coupler C-10 | 0.05 |
| Coupler C-11 | 0.01 |
| Coupler C-12 | 0.08 |
| Coupler C-1 | 0.02 |
| Coupler C-9 | 0.02 |
| Dispersion oil, Oil-1 | 0.10 |
| Dispersion oil, Oil-2 | 0.05 |

Eighth Layer (Yellow filter layer):

| | |
|---|---|
| Gelatin | 1.2 |
| Yellow colloidal silver | 0.08 |
| Compound, Cpd-B | 0.1 |
| Dispersion oil, Oil-1 | 0.3 |

Ninth Layer (First blue-sensitive emulsion layer):

| | |
|---|---|
| Monodispersed silver iodobromide emulsion (silver iodide: 4 mol %, average grain size: 0.3 μm) | 0.4 |
| Gelatin | 1.0 |
| Sensitizing Dye V | $2 \times 10^{-4}$ |
| Coupler C-13 | 0.9 |
| Coupler C-5 | 0.07 |
| Dispersion oil, Oil-1 | 0.2 |

Tenth Layer (Second blue-sensitive emulsion layer):

| | |
|---|---|
| Silver iodobromide emulsion (silver iodide 10 mol %, average grain size: 1.5 μm) | 0.5 |
| Gelatin | 0.6 |
| Sensitizing Dye V | $1 \times 10^{-4}$ |
| Coupler C-13 | 0.25 |

-continued

| | |
|---|---|
| Dispersion oil, Oil-1 | 0.07 |

Eleventh Layer (First protective layer):

| | |
|---|---|
| Gelatin | 0.8 |
| Ultraviolet light absorbent UV-1 | 0.1 |
| Ultraviolet light absorbent UV-2 | 0.2 |
| Dispersion oil, Oil-1 | 0.01 |
| Dispersion oil, Oil-1 | 0.01 |

Twelfth Layer (Second protective layer):

| | |
|---|---|
| Fine silver bromide grains (average grain size: 0.07 μm) | 0.5 |
| Gelatin | 0.45 |
| Polymethyl methacrylate particles (diameter: 1.5 μm) | 0.2 |
| Hardener, H-1 | 0.4 |
| Formaldehyde scavenger, S-1 | 1.0 |

A surfactants was added as a coating aid to each layer, in addition to the above-mentioned components. The chemical structure or chemical name of each compound used in this Example is given below.

UV-1

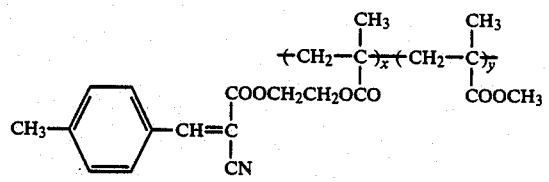

x/y = 7/3 (weight ratio)

UV-2

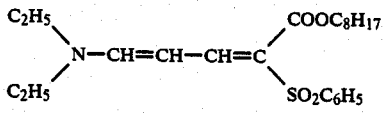

| | |
|---|---|
| Tricresyl phosphate | Oil-1 |
| Dibutyl phthalate | Oil-2 |
| Bis(2-ethylhexyl)phthalate | Oil-3 |

C-1

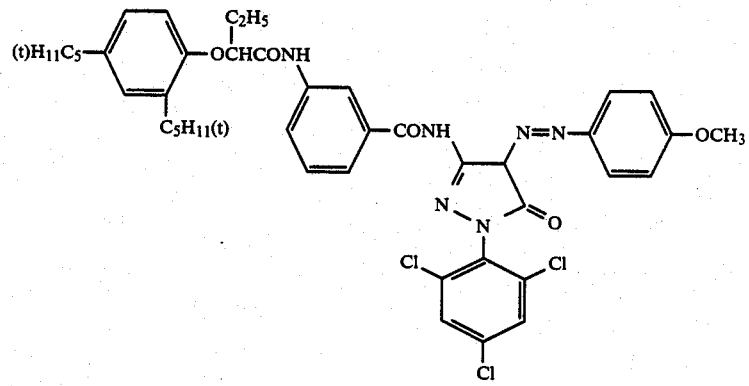

C-2

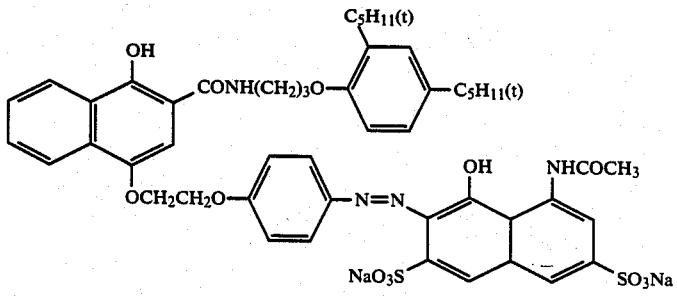

-continued
C-3
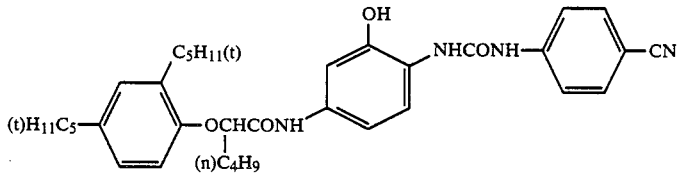
C-4
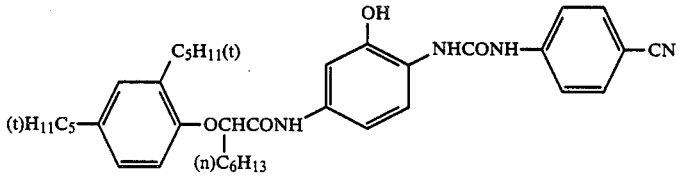
C-5
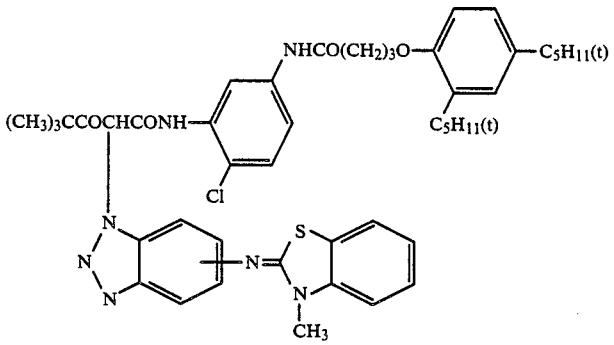
C-6
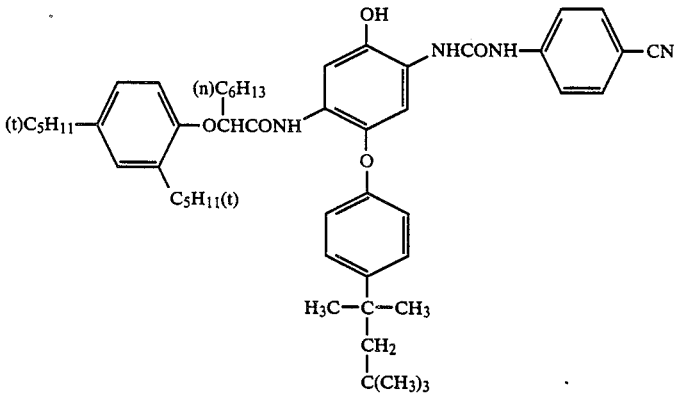
C-7
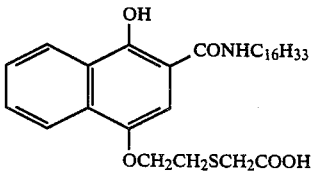
C-8
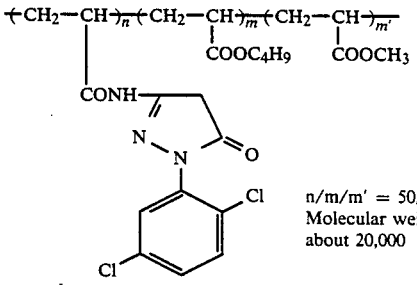
n/m/m' = 50/25/25
Molecular weight:
about 20,000

-continued
C-9
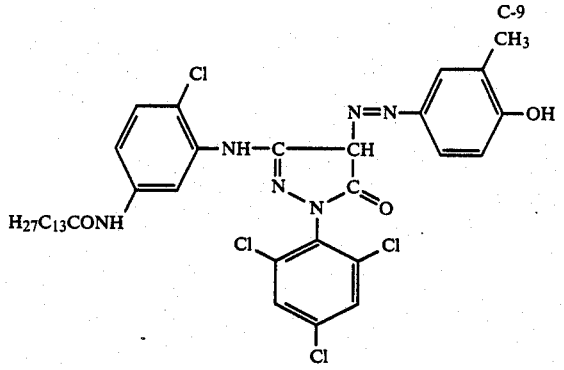
C-10
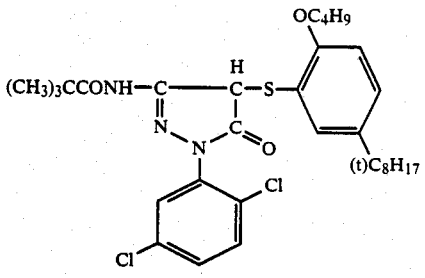
C-11
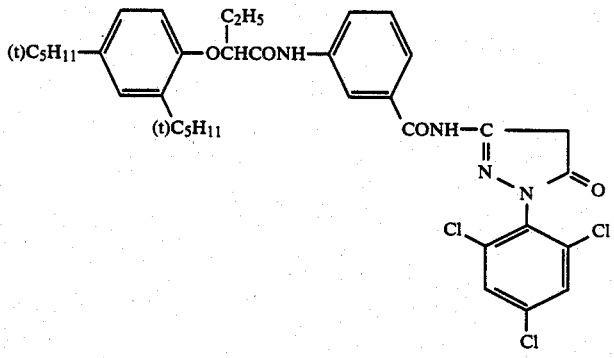
C-12
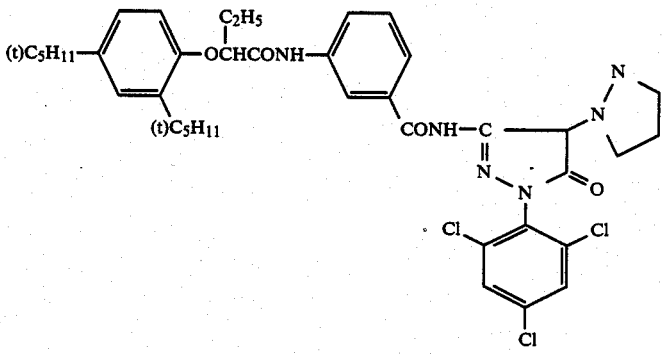
C-13
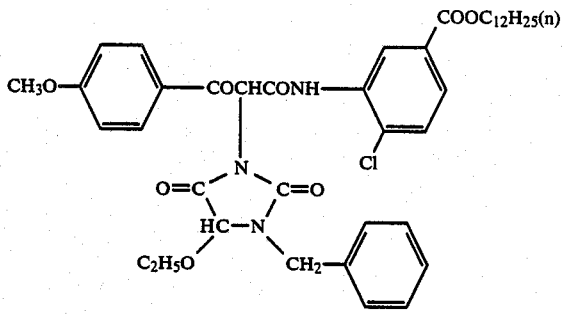
Cpd-A
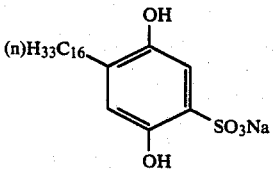
Cpd-B
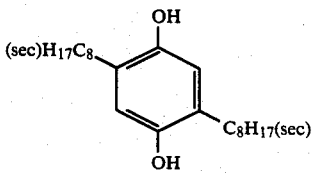

-continued
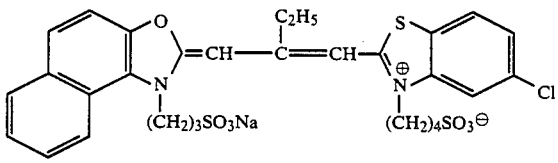
Sensitizing Dye I
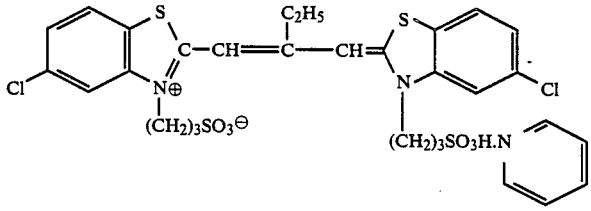
Sensitizing Dye II
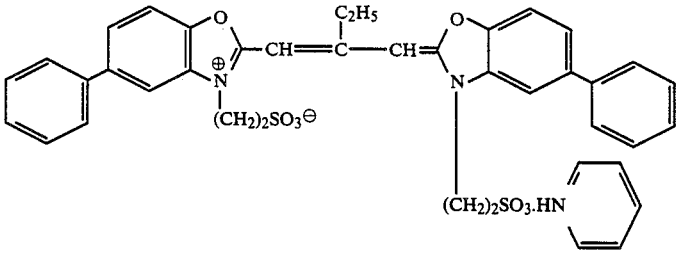
Sensitizing Dye III
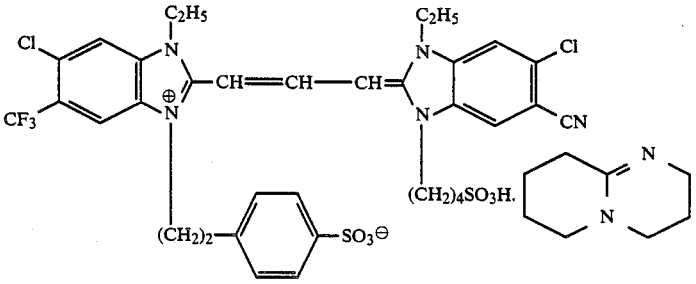
EX-1
Sensitizing Dye IV
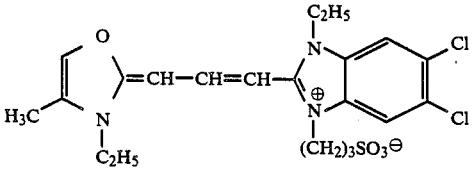
Sensitizing Dye V
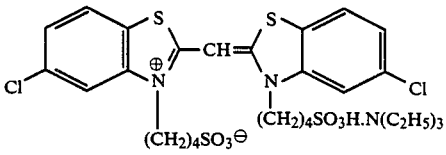
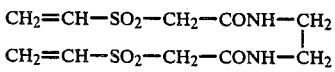
H-1
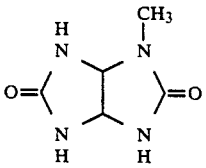
S-1

-continued

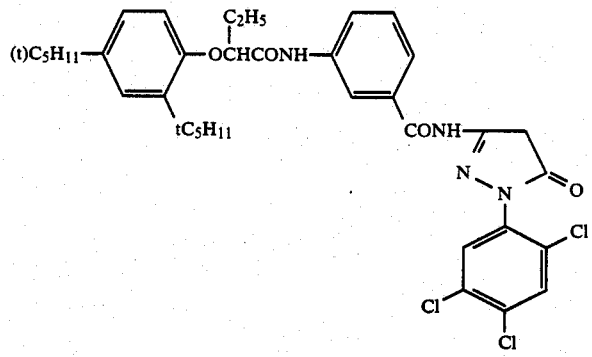

Coupler A

Each of the thus prepared color photographic material samples was cut into a film having a width of 35 mm, and a standard object was photographed with each film in the open air. The photographed films were processed in an automatic developing machine under the conditions as shown in Table 1. In the washing step (2), the amount of the replenisher was about 60 times (in treatment (A)) and about 13 times (in treatment (B)) the carried-over amount by the photographic material from the washing step (1).

TABLE 1

| Step | Time | Temperature (°C.) | Capacity (l) | Amount of Replenisher (*) Treatment (A) (ml) | Treatment (B) (ml) |
|---|---|---|---|---|---|
| Color development | 3'15" | 38 | 18 | 38 | 38 |
| Bleaching | 6'30" | 38 | 36 | 18 | 18 |
| Fixing | 3'15" | 38 | 18 | 33 | 33 |
| Washing (1) | 1'30" | 38 | 9 | — | — |
| Washing (2) | 1'30" | 38 | 9 | 125 | 27 |
| Stabilization | 40" | 38 | 9 | 33 | 33 |

Note (*): The amount was based on the film having a length of 1 m and a width of 35 mm.

In the rinsing steps (1) and (2) in the above processing treatment, the washing water was run from the washing bath (2) to the washing bath (1) in a countercurrent system.

The composition of each of the processing solutions used is given below.

Color Developer:

| | Tank | Replenisher |
|---|---|---|
| Diethylenetriaminepentaacetic acid | 1.0 g | 1.0 g |
| 1-Hydroxyethylidene-1,1-diphosphonic acid | 2.0 g | 2.2 g |
| Sodium sulfite | 4.0 g | 4.4 g |
| Potassium carbonate | 30.0 g | 32.0 g |
| Potassium bromide | 1.4 g | 0.7 g |
| Potassium iodide | 1.3 mg | — |
| Hydroxylamine sulfate | 2.4 g | 2.6 g |
| 4-(N—Ethyl-N—β-hydroxyethylamino)-2-methylaniline sulfate | 4.5 g | 5.0 g |
| Water to make | 1 liter | 1 liter |
| pH | 10.00 | 10.05 |

Bleaching Solution:

| | Tank | Replenisher |
|---|---|---|
| Ferric ammonium ethylenediamine-tetraacetate | 100 g | 110 g |
| Disodium ethylenediamine-tetraacetate | 10.0 g | 11.0 g |
| Aqueous ammonia | 7 ml | 5 ml |
| Ammonium nitrate | 10.0 g | 12.0 g |
| Ammonium bromide | 150 g | 170 g |
| Water to make | 1 liter | 1 liter |
| pH | 6.0 | 5.8 |

Fixing Solution:

| | Tank | Replenisher |
|---|---|---|
| Disodium ethylenediamine-tetraacetate | 1.0 g | 1.2 g |
| Sodium sulfite | 4.0 g | 5.0 g |
| Sodium bisulfite | 4.6 g | 5.8 g |
| Ammonium thiosulfate aqueous solution (70%) | 175 ml | 200 ml |
| Water to make | 1 liter | 1 liter |
| pH | 6.6 | 6.6 |

Washing Solution:

| | Tank | Replenisher |
|---|---|---|
| 2-Methylisothiazolin-3-one | 10 mg | 10 mg |
| 5-Chloro-2-methylisothiazolin-3-one | 10 mg | 10 mg |
| Water to make | 1 liter | 1 liter |
| pH (as regulated with sodium hydroxide) | 7.0 | 7.0 |

Stabilizing Solution:

| | Tank | Replenisher |
|---|---|---|
| Formalin (37% w/v) | 2.0 ml | 3.0 ml |
| Polyoxyethylene-p-monononylphenyl ether (average polymerization degree: 10) | 0.3 g | 0.45 g |
| Water to make | 1 liter | 1 liter |

In the first place, each of the photographed color photographic material Sample Nos. 101 through 112 (width: 35 mm) was continuously processed in the automatic developing machine having the tank capacity as shown in the above Table 1 in a length of 20 m a day for 20 days.

Next, each sample was exposed to a tungsten lamp through a wedge of 20 CMS, whereupon the color temperature was regulated to be 4800° K. with a filter, and then processed with the used solution from the above-described automatic developing machine which had been continuously processed for 20 days.

The magenta density of each of the samples was measured with a densitometer, and the Dmin was evaluated.

The results are given in Table 2.

TABLE 2

| Sample No. | Coupler in 6th Layer | Sensitizing Dye in 6th Layer | Dmin of Magenta Image Treatment (A) | Dmin of Magenta Image Treatment (B) | ΔDmin (Treatment (B) − Treatment (A)) |
|---|---|---|---|---|---|
| 101 (Comparison) | C-8 | III | 0.52 | 0.56 | +0.04 |
| 102 (Comparison) | A | " | 0.52 | 0.56 | +0.04 |
| 103 (Comparison) | MC-5 | " | 0.55 | 0.57 | +0.02 |
| 104 (comparison) | MC-1 | " | 0.54 | 0.56 | +0.02 |
| 105 (Comparison) | C-8 | I-11 | 0.53 | 0.56 | +0.03 |
| 106 (Comparison) | A | " | 0.53 | 0.56 | +0.03 |
| 107 (Invention) | MC-5 | " | 0.55 | 0.55 | ±0 |
| 108 (Invention) | MC-1 | " | 0.55 | 0.55 | ±0 |
| 109 (Comparison) | C-8 | II-5 | 0.53 | 0.56 | +0.03 |
| 110 (Invention) | MC-5 | " | 0.56 | 0.57 | +0.01 |
| 111 (Comparison) | MC-5 | EX-1 | 0.56 | 0.58 | +0.02 |
| 112 (Invention) | MC-5 | I-12/II-5 (1/1)* | 0.55 | 0.55 | ±0 |

Note
*Molar ratio

As apparent from the above Table 2, the combinations according to the present invention are extremely less in difference of Dmin between treatment (A) and treatment (B) and give substantially no increase in Dmin even when the amount of the washing solution used is reduced.

Further, it is confirmed that the sharpness of the samples of the present invention almost is not lowered even in treatment (B).

EXAMPLE 2

Sample Nos. 201 to 238 were prepared in the same manner as the preparation of Sample No. 101, with the exception that Coupler C-8 was replaced by an equimolar amount of each of the couplers as shown in Table 4 and that Sensitizing Dye III was replaced by each of the sensitizing dyes as shown in Table 4.

Each of the thus prepared samples was cut into a film and photographed in the same manner as in Example 1. The photographic films were processed in an automatic developing machine under the conditions as shown in Table 3, such that the accumulated amount of the replenisher was 3 times the volume of the tank.

The Dmin of each of the thus processed samples was evaluated.

The results are given in Table 4.

The chemical structure of each compound used in this Example is given below.

Coupler B

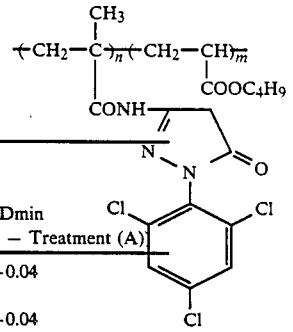

n/m = 50/50
molecular weight: about 12,000

Coupler C

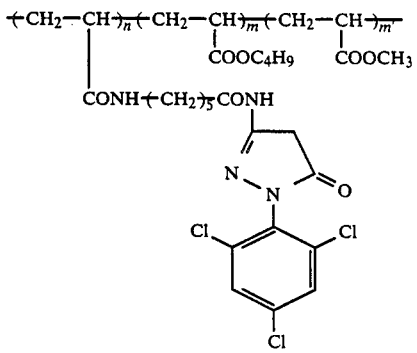

n/m/m' = 50/25/25
molecular weight: about 15,000

EX-2

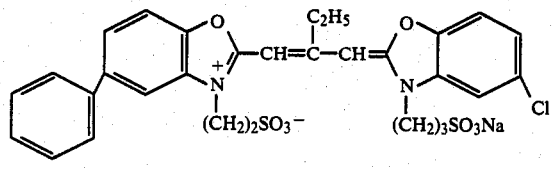

EX-3

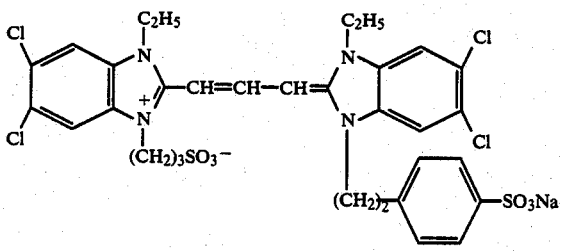

TABLE 3

| Step | Time | Temperature (°C.) | Amount of Replenisher (*) Treatment (C) | Treatment (D) |
|---|---|---|---|---|
| Color development | 3'15" | 38 | 35 ml | 35 ml |
| Bleaching | 1'00" | 38 | 20 ml | 20 ml |
| Bleach-fixing | 3'15" | 38 | 30 ml | 30 ml |
| Washing (1) | 40" | 35 | Countercurrent system of (2) → (1) | Countercurrent system of (2) → (1) |
| Washing (2) | 1'00" | 35 | 130 ml | 25 ml |
| Stabilization | 40" | 38 | 20 ml | 20 ml |

Note (*): The amount was based on the film having a length of 1 m and a width of 35 mm.

The composition of each of the processing solutions used is given below.

Color Developer:

| | Tank | Replenisher |
|---|---|---|
| Diethylenetriaminepentaacetic acid | 1.0 g | 1.0 g |
| 1-Hydroxyethylidene-1,1-diphosphonic acid | 2.0 g | 2.2 g |
| Sodium sulfite | 4.0 g | 4.9 g |
| Potassium carbonate | 30.0 g | 42.0 g |
| Potassium bromide | 1.6 g | — |
| Potassium iodide | 2.0 mg | — |
| Hydroxylamine sulfate | 2.4 g | 3.6 g |
| 4-(N—Ethyl-N—β-hydroxyethylamino)-2-methylaniline sulfate | 5.0 g | 7.3 g |

-continued

| | | |
|---|---|---|
| Water to make | 1 liter | 1 liter |
| pH | 10.00 | 10.05 |
| Bleaching Solution (common between mother liquor and replenisher): | | |
| Ferric ammonium ethylenediaminetetraacetate | | 120.0 g |
| Disodium ethylenediaminetetraacetate | | 10.0 g |
| Ammonium nitrate | | 10.0 g |
| Ammonium bromide | | 100.0 g |
| Bleaching accelerator | | $5 \times 10^{-3}$ mole |

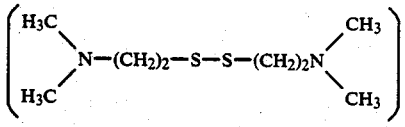

| | |
|---|---|
| pH (as regulated with aqueous ammonia) | 6.3 |
| Water to make | 1.0 liter |
| Bleach-fixing Solution (common between mother liquor and replenisher): | |
| Ferric ammonium ethylenediaminetetraacetate | 50.0 g |
| Disodium ethylenediaminetetraacetate | 5.0 g |
| Sodium sulfite | 12.0 g |
| Ammonium thiosulfate aqueous solution (70%) | 240 ml |
| pH (as regulated with aqueous ammonia) | 7.3 |
| Water to make | 1 liter |

Washing Solution:

Tap water processed by passing through a mixed bed column having filled therein an H-type strongly acidic cation exchange resin (Diaion ® SK, a product of Mitsubishi Chemical Industries Limited) and an OH-type strongly basic anion exchange resin (Diaion ® SA-10A, a product of Mitsubishi Chemical Industries Limited) to have a water condition as shown below and then adding thereto 20 mg/liter of sodium dichloroisocyanurate.

| | |
|---|---|
| Calcium ion | 1.1 mg/liter |
| Magnesium ion | 0.5 mg/liter |
| pH | 6.9 |

Stabilizing Solution:

| | Tank | Replenisher |
|---|---|---|
| Formalin (37% w/v) | 2.0 ml | 3.0 ml |
| Polyoxyethylene-p-monononylphenyl ether (average polymerization degree: 10) | 0.3 g | 0.45 g |
| Disodium ethylenediaminetetraacetate | 0.05 g | 0.07 g |
| Water to make | 1 liter | 1 liter |
| pH | about 6.0 | about 6.0 |

TABLE 4

| Sample | Coupler in 6th Layer | Sensitizing Dye in 6th Layer | Dmin of Magenta Image Treatment (C) | Treatment (D) | ΔDmin (Treatment (D) − Treatment (C)) |
|---|---|---|---|---|---|
| 201* | C-8 | III | 0.52 | 0.58 | +0.06 |
| 202* | A | " | 0.52 | 0.58 | +0.06 |
| 203* | B | " | 0.52 | 0.57 | +0.05 |
| 204* | C | " | 0.52 | 0.58 | +0.06 |
| 205* | MC-5 | " | 0.54 | 0.58 | +0.04 |
| 206* | MC-14 | " | 0.54 | 0.58 | +0.05 |
| 207* | MC-15 | " | 0.53 | 0.57 | +0.04 |
| 208* | C-8 | EX-2 | 0.52 | 0.57 | +0.05 |
| 209* | A | " | 0.53 | 0.58 | +0.05 |
| 210* | B | " | 0.53 | 0.58 | +0.05 |
| 211* | C | " | 0.53 | 0.59 | +0.06 |
| 212* | MC-5 | " | 0.56 | 0.60 | +0.04 |
| 213* | MC-14 | " | 0.54 | 0.59 | +0.05 |
| 214* | MC-15 | " | 0.53 | 0.57 | +0.04 |

TABLE 4-continued

| Sample | Coupler in 6th Layer | Sensitizing Dye in 6th Layer | Dmin of Magenta Image Treatment (C) | Dmin of Magenta Image Treatment (D) | ΔDmin (Treatment (D) − Treatment (C)) |
|---|---|---|---|---|---|
| 215* | C-8 | EX-3 | 0.54 | 0.60 | +0.06 |
| 216* | A | " | 0.54 | 0.59 | +0.05 |
| 217* | B | " | 0.54 | 0.59 | +0.05 |
| 218* | C | " | 0.54 | 0.59 | +0.05 |
| 219* | MC-5 | " | 0.57 | 0.62 | +0.05 |
| 220* | MC-14 | " | 0.56 | 0.60 | +0.04 |
| 221* | MC-15 | " | 0.56 | 0.60 | +0.04 |
| 222* | C-8 | I-11 | 0.52 | 0.57 | +0.05 |
| 223* | A | " | 0.53 | 0.58 | +0.05 |
| 224* | B | " | 0.53 | 0.58 | +0.05 |
| 225* | C | " | 0.53 | 0.57 | +0.04 |
| 226 | MC-5 | " | 0.55 | 0.57 | +0.02 |
| 227 | MC-14 | " | 0.54 | 0.56 | +0.02 |
| 228 | MC-15 | " | 0.54 | 0.55 | +0.01 |
| 229* | C-8 | I-9 | 0.52 | 0.56 | +0.04 |
| 230* | A | " | 0.52 | 0.57 | +0.05 |
| 231 | MC-5 | " | 0.55 | 0.56 | +0.01 |
| 232 | MC-14 | " | 0.54 | 0.56 | +0.02 |
| 233 | MC-15 | " | 0.54 | 0.56 | +0.02 |
| 234* | C-8 | II-6 | 0.51 | 0.56 | +0.05 |
| 235* | A | " | 0.52 | 0.57 | +0.05 |
| 236 | MC-5 | " | 0.55 | 0.56 | +0.01 |
| 237 | MC-14 | " | 0.54 | 0.55 | +0.02 |
| 238 | MC-15 | " | 0.53 | 0.55 | +0.02 |

(Note)
*indicates comparative samples.

As apparent from the above Table 4, the combinations according to the present invention are extremely less in difference of Dmin between treatment (C) and treatment (D) and give stable photographic properties even when the amount of the washing solution used is reduced.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide color photographic material by fixing or bleach-fixing the material and immediately thereafter subjecting it to washing or stabilization, wherein (A) the silver halide color photographic material contains at least one of sensitizing dyes represented by the following formulae (I) and (II) and at least one two-equivalent magenta polymer coupler which is derived from a monomer coupler of the following formula (III) and which has a repeating unit represented by the following formula (IV), and (B) the amount of a replenisher in the washing step and/or the stabilization step falls within the range of 3 to 50 times, based on unit area of the material after being processed, the amount of each processing solution having been carried over from the preceding bath:

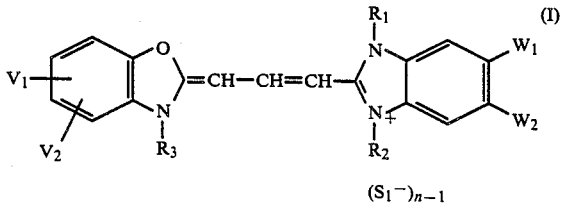

wherein $V_1$ and $V_2$ each represents a hydrogen atom, an alkyl group, an alkoxy group, a chlorine atom, a phenyl group, a substituted phenyl group, or a hydroxyl group, or $V_1$ and $V_2$ may together form a condensed benzene ring, $W_1$ represents a hydrogen atom, a fluorine atom, or chlorine atom; $W_2$ represents a hydrogen atom, a fluorine atom, an acyl group, an alkoxycarbonyl group, a sulfamoyl group, a cyano group, a fluorine-substituted alkyl group, or an alkylsulfonyl group, $R_1$, $R_2$ and $R_3$, which may be the same or different, each represents an alkyl group or a substituted alkyl group, with the proviso that at least one of $R^2$ and $R^3$ represents a substituted alkyl group having a sulfo group or a carboxyl group; $X_1$ represents an acid anion; and n is 1 or 2;

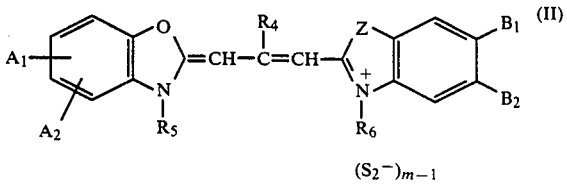

wherein Z represents a sulfur atom or a selenium atom; $A_1$ and $A_2$, which may be the same or different, each has the same meanings as in $V_1$ or $V_2$ in the formula (I); $B_1$ represents a hydrogen atom, a lower alkyl group having 5 or less carbon atoms, a lower acylamino group having 5 or less carbon atoms, or a lower alkoxy group having 4 or less carbon atoms; when $B_1$ is a hydrogen atom, $B_2$ represents a lower acylamino group having 5 or less carbon atoms, a lower alkoxylcarbonyl group having 6 or less carbon atoms, or a carboxyl group, when $B_1$ is a lower alkoxy group, $B_2$ additionally represents a lower alkyl group having 5 or less carbon atoms, a lower acylamino group having 5 or less carbon atoms, a chlorine atom, a substituted or unsubstituted phenyl group, a hydroxyl group, a lower alkoxycarbonyl group having 5 or less carbon atoms, or a carboxyl group, and when $B_1$ is a lower alkyl group or a lower acylamino group, $B_2$ additionally represents a lower alkoxy group having 5 or less carbon atoms; $R_4$ represents a hydrogen atom, a lower alkyl group having 4 or less carbon atoms, or an aralkyl group, $R_5$ and $R_6$ each has the same meanings as in $R_1$, $R_2$, or $R_3$ in the formula (I), provided that at least one of $R_5$ and $R_6$ represents an alkyl group containing a sulfo group or a carboxyl group; $X_2$ represents an acid anion residue; and M is 1 or 2;

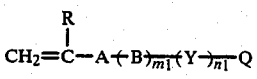

(III)

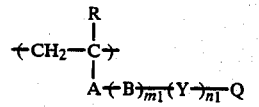

(IV)

wherein R represents a hydrogen atom, a lower alkyl group having 1 to 4 carbon atoms, or a chlorine atom; A represents —CONH—, —COO—, —O—, or a phenylene group; B represents a substituted or unsubstituted alkylene group which may be straight or branched chain, a substituted or unsubstituted aralkylene group, or a substituted or unsubstituted phenylene group; Y represents —CONR'—, 'NR'CONR'—, —NR'$CO_2$—, —NR'CO—, —OCONR'—, —NR'—, —$CO_2$—, —OCO—, —CO—, —O—, —$SO_2$—, —NR'$SO_2$—, —$SO_2$NR'—, or —S—, wherein R' represents a hydrogen atom, a substituted or unsubstituted aliphatic group, or a substituted or unsubstituted aryl group, provided that wherein two or more of R' are present in the molecule, they may be the same or different; $n_1$ is 0 or 1; when $n_1$ is 0, $m_1$ is 1, when $n_1$ is 1, $m_1$ is 1; and Q represents a two-equivalent magenta coupler residue capable of forming a dye upon coupling with an oxidation product of an aromatic primary amine developing agent, wherein the at least one of sensitizing dyes is present in an amount of from $1\times10^{-6}$ to $5\times10^{-3}$ mole per mole of the silver halide.

2. A method for processing a silver halide color photographic material as claimed in claim 1, wherein $W_2$ represents a cyano group or a trifluoromethyl group, and $V_1$ or $V_2$ represents a 5-positioned phenyl group or chlorine atom, or $V_1$ and $V_2$ together form a condensed benzene ring, in the formula (I).

3. A method for processing a silver halide color photographic material as claimed in claim 1, wherein one of $A_1$ and $A_2$ represents a 5-positioned phenyl group, chlorine atom, methoxy group or ethoxy group, with the other being a hydrogen atom, or $A_1$ and $A_2$ together form a 5,6- or 6,7-condensed benzene ring; $B_1$ represents a methyl group, an ethyl group, a methoxy group, an ethoxy group, an acetylamino group, or a propionylamino group; $B_2$ represents a methyl group, an ethyl group, an acetylamino group, a propionylamino group or a chlorine atom; and $R_4$ represents an ethyl group or a propyl group, in the formula (II).

4. A method for processing a silver halide color photographic material as claimed in claim 1, wherein Q in the formulae (III) and (IV) represents a residue of a 5-pyrazolone of the following formula (V) or (VI):

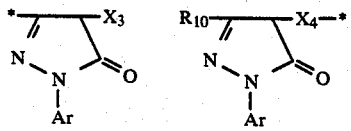

(V) (VI)

wherein Ar represents an alkyl group, a substituted alkyl group, an aryl group, or a substituted aryl group; $R_{10}$ represents a substituted or unsubstituted anilino group, a substituted or unsubstituted acylamino group, or a substituted or unsubstituted ureido group; $X_3$ represents a coupling split-off group bonded to the coupling position of the molecule via a nitrogen atom, a sulfur atom, or an oxygen atom; $X_4$ represents a divalent free radical derived from X by removing one hydrogen atom therefrom; and * represents a position to which $\overline{(Y)_{n1}}$ inthe formula (III) or (IV) bonds.

5. A method for processing a silver halide color photographic material as claimed in claim 1, wherein Q inthe formulae (III) and (IV) represents a residue of a pyrazoloazole of the following formula (VII):

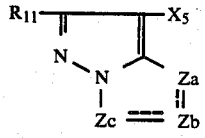

(VII)

wherein $R_{11}$ represents a hydrogen atom or an organic substituent; $X_5$ represents a group capable of being cleaved and removed upon a coupling reaction with an oxidization product of an aromatic primary amine developing agent; Za, Zb and Zc each represents a methine group, a substituted methine group, =N—, or —NH—, with one of the Za—Zb bond and the Zb—Zc bond being a double bond and the other being a single bond, and when Zb—Zc bond is a carbon-carbon double bond, this may be a part of an aromatic ring; and $R_{11}$, $X_5$ or a substituted methine group of Za, Zb or Zc may be a divalent group to bond to $\overline{(Y)_{n1}}$ in the formula (III) or (IV).

6. A method for processing a silver halide color photographic material as claimed in claim 5, wherein the pyrazoloazole is selected from compounds of the following formulae (F-1), (F-2), (F-3), (F-4), (F-5) and (F-6):

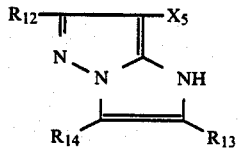

(F-1)

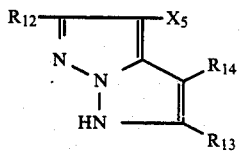

(F-2)

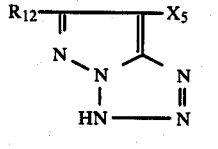

(F-3)

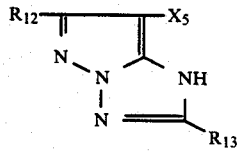

(F-4)

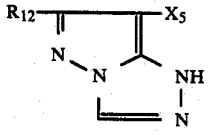

(F-5)

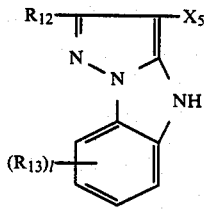

(F-6)

wherein $R_{12}$, $R_{13}$ and $R_{14}$ each represents an aliphatic hydrocarbon group, an aromatic group or a heterocyclic group; $X_5$ is the same as defined in claim 5; and l represents an integer of from 0 to 4, provided that any one of $R_{12}$, $R_{13}$, $R_{14}$, and $X_5$ is a divalent group to be linked with $-(Y)_{\overline{m1}}$ of the formula (III) or (IV).

7. A method for processing a silver halide color photographic material as claimed in claim 6, wherein the pyrazoloazole is selected from compounds of the formulae (F-1), (F-3), and (F-4).

8. A method for processing a silver halide color photographic material as claimed in claim 6, wherein the pyrazoloazole is a compound of the formula (F-4).

9. A method for processing a silver halide color photographic material as claimed in claim 1, wherein the sensitizing dye is incorporated in a silver halide photographic emulsion of the silver halide color photographic material in an amount of from $1\times10^{-6}$ mole to $5\times10^{-3}$ mole per mole of the silver halide.

10. A method for processing a silver halide color photographic material as claimed in claim 1, wherein the amount of the two-equivalent magneta polymer coupler is 30 mole% or more of the total amount of magenta couplers in the silver halide color photographic material.

11. A method for processing a siler halide color photographic material as claimed in claim 1, wherein the two-equivalent magenta polymer coupler is added in an amount of from 0.005 mole to 0.5 mole per mole of the silve halide, based on the coupler monomer thereof.

12. A method for processing a silver halide color photographic material as claimed in claim 1, wherein the two-equivalent magenta polymer coupler is added in an amount of from 0.01 mole to 0.05 mole per mole of the silver halide, based on the coupler monomer thereof.

13. A method for processing a silver halide color photographic material as claimed in claim 1, wherein the sensitizing dye represented by the formula (I) is selected from the following formulae I-1 to I-14:

I-1

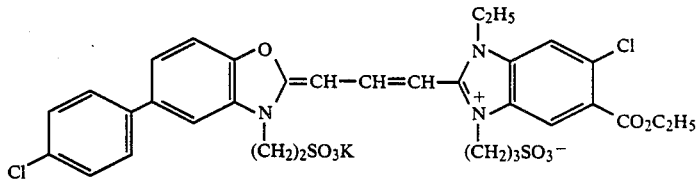

I-2

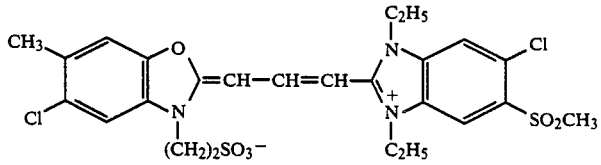

I-3

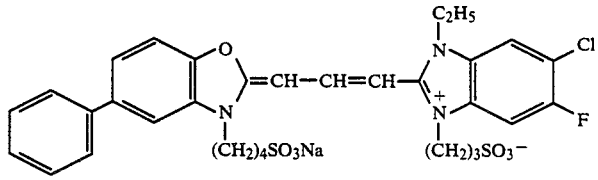

I-4

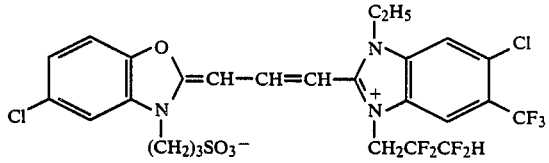

I-5

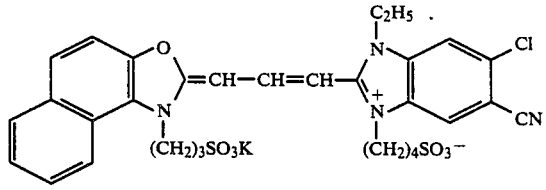

I-6

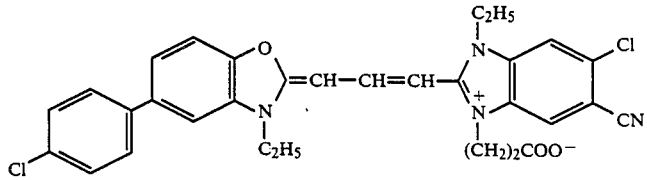

-continued
I-7
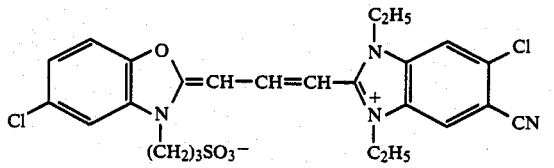
I-8
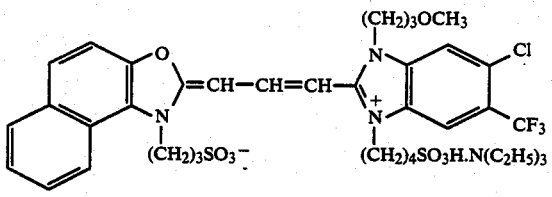
I-9
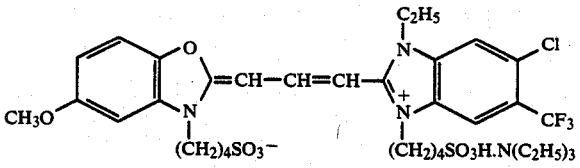
I-10
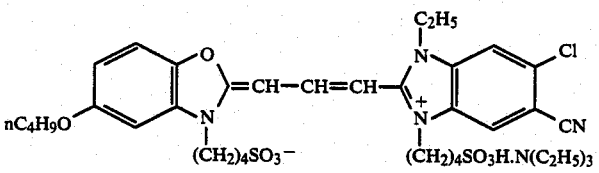
I-11
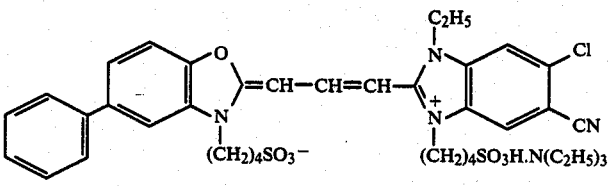
I-12
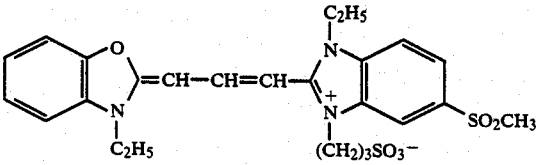
I-13
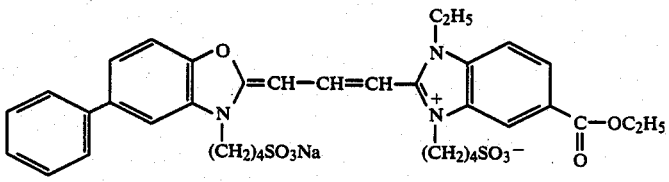
I-14
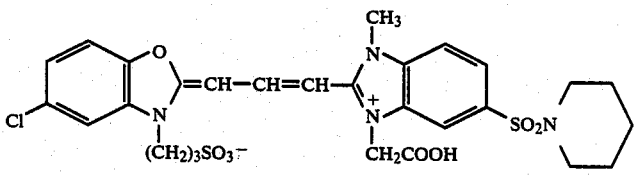
14. A method for processing a silver halide color photographic material as claimed in claim 1, wherein the sensitizing dye represented by the formula (II) is selected from the following formulae II-1 to II-11:

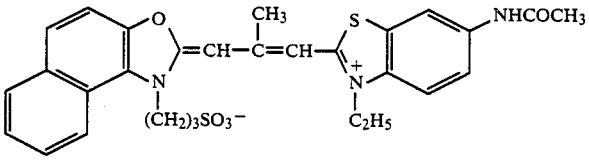
II-1
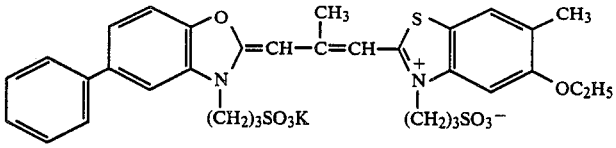
II-2
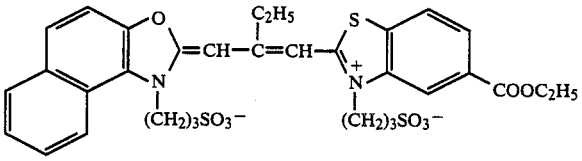
II-3
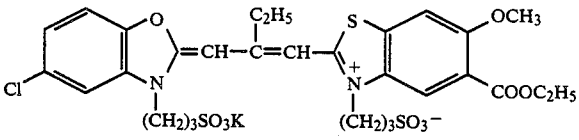
II-4
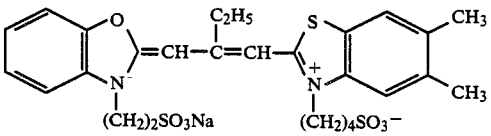
II-5
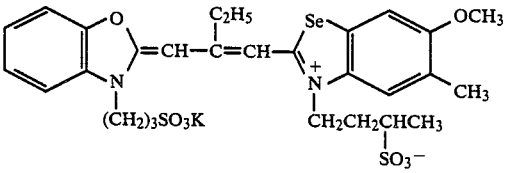
II-6
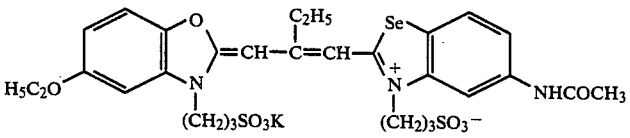
II-7
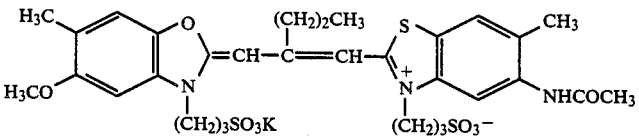
II-8
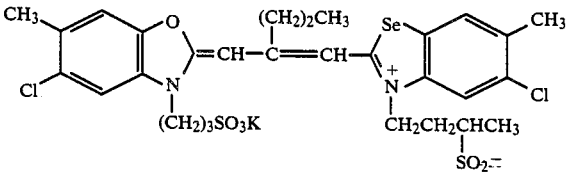
II-9

-continued
II-10
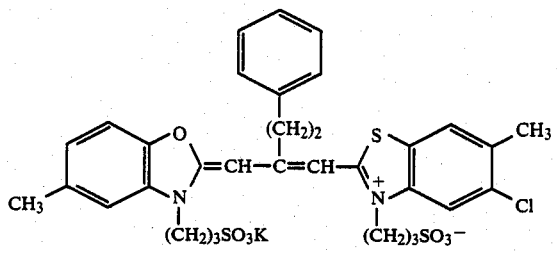
II-11
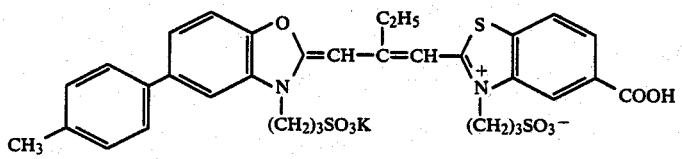
15. A method for processing a silver halide color photographic material as claimed in claim 1, wherein the two-equivalent magenta polymer coupler has an azole group as a split-off group.
* * * * *